US010964266B2

(12) United States Patent
Lee

(10) Patent No.: US 10,964,266 B2
(45) Date of Patent: Mar. 30, 2021

(54) DRIVING VOLTAGE SUPPLY CIRCUIT, DISPLAY PANEL, AND DISPLAY DEVICE

(71) Applicant: LG Display Co., Ltd., Seoul (KR)

(72) Inventor: Juseok Lee, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/539,840

(22) Filed: Aug. 13, 2019

(65) Prior Publication Data

US 2020/0074930 A1 Mar. 5, 2020

(30) Foreign Application Priority Data

Aug. 29, 2018 (KR) ..... 10-2018-0101922

(51) Int. Cl.

| | |
|---|---|
| ***G09G 3/32*** | (2016.01) |
| ***G09G 3/3258*** | (2016.01) |
| ***G09G 3/3233*** | (2016.01) |
| ***G05F 1/571*** | (2006.01) |

(52) U.S. Cl.

CPC ..... *G09G 3/3258* (2013.01); *G05F 1/571* (2013.01); *G09G 3/3233* (2013.01); *G09G 2300/0819* (2013.01); *G09G 2300/0842* (2013.01); *G09G 2310/0243* (2013.01); *G09G 2310/0251* (2013.01); *G09G 2320/0233* (2013.01); *G09G 2320/0295* (2013.01); *G09G 2320/045* (2013.01); *G09G 2330/028* (2013.01)

(58) Field of Classification Search

CPC .... G09G 3/3258; G09G 3/322; G09G 3/3696; G09G 2320/0295; G09G 2320/045; G09G 2320/0233; G09G 2310/0251; G09G 2310/0243; G09G 2330/028; G05F 1/571

See application file for complete search history.

(56) References Cited

U.S. PATENT DOCUMENTS

| | | | | |
|---|---|---|---|---|
| 8,558,825 | B2 * | 10/2013 | Bae | G09G 3/3233 345/211 |
| 10,115,334 | B2 * | 10/2018 | Lin | G09G 3/20 |
| 2015/0348463 | A1 * | 12/2015 | Lee | G09G 3/3233 345/690 |
| 2016/0379569 | A1 * | 12/2016 | Lee | G09G 3/3275 345/77 |
| 2018/0005581 | A1 * | 1/2018 | Kim | G09G 3/3275 |
| 2020/0143753 | A1 * | 5/2020 | Park | G09G 3/3233 |

* cited by examiner

*Primary Examiner* — Liliana Cerullo
(74) *Attorney, Agent, or Firm* — Polsinelli PC

(57) ABSTRACT

A drive voltage supply circuit, a display panel, and a display device are provided. By supplying a drive voltage lower than a drive voltage for display driving in a period in which sensing deterioration of an organic light emitting diode disposed in each sub pixel, an operating voltage of the organic light emitting diode is kept constant and a degree of deterioration of the organic light emitting diode can be accurately sensed. By discharging the drive voltage supplied to the display panel and controlling a current flowing in the process of discharge before supplying the drive voltage for deterioration sensing, drive voltages of different levels can be stably supplied in a display driving period and a deterioration sensing period.

12 Claims, 17 Drawing Sheets

DRIVING VOLTAGE SUPPLY CIRCUIT, DISPLAY PANEL, AND DISPLAY DEVICE

CROSS REFERENCE TO RELATED APPLICATION

This application claims priority from Korean Patent Application No. 10-2018-0101922, filed on Aug. 29, 2018, which is hereby incorporated by reference in its entirety.

BACKGROUND

Field of the Disclosure

The present disclosure relates to a display device, and more particularly, to a drive voltage supply circuit, a display panel, and a display device.

Description of the Background

With the advancement of information-oriented societies, requirements for display devices displaying an image have increased in various types, and various display devices such as a liquid crystal display device and an organic light emitting display device have been widely utilized.

An organic light emitting display device out of such display devices has a high response speed and is excellent in contrast range, luminous efficiency, luminance, and viewing angle because it employs an organic light emitting diode that voluntarily emits light.

Such an organic light emitting display device includes an organic light emitting diode that is disposed in each of a plurality of subpixels arranged in a display panel and can control luminance exhibited by the subpixels and display an image by causing the organic light emitting diodes to emit light by controlling a current flowing in the organic light emitting diodes.

Here, the organic light emitting diode included in each subpixel can deteriorate with the elapse of time and luminance which is to be exhibited by each subpixel may not be displayed due to the deterioration. There is also a problem in that image quality decreases due to deterioration deviations of the organic light emitting diodes included in the subpixels.

SUMMARY

The present disclosure provides a display panel and a display device that can sense deterioration of an organic light emitting diode which is disposed in each subpixel of the display panel and perform compensation based on the sensed deterioration.

The present disclosure provides a deterioration sensing method that can improve accuracy of deterioration sensing of organic light emitting diodes and a drive voltage supply circuit, a display panel, and a display device that can enable such deterioration sensing.

The present disclosure provides measures for preventing damage of a drive voltage supply circuit that can improve accuracy of deterioration sensing and enabling the drive voltage supply circuit to operate normally in a display driving period and a deterioration sensing period.

According to an aspect of the present disclosure, there is provided a display device including: a display panel in which a plurality of gate lines, a plurality of data lines, and a plurality of subpixels are arranged; a gate driving circuit that drives the plurality of gate lines; a data driving circuit that drives the plurality of data lines; a drive voltage supply circuit that supplies a drive voltage to the display panel; and a controller that controls the gate driving circuit, the data driving circuit, and the drive voltage supply circuit.

In this display device, each of the plurality of subpixels includes an organic light emitting diode, a driving transistor that drives the organic light emitting diode, a switching transistor that is electrically connected between a gate node of the driving transistor and the corresponding data line, and a sensing transistor that is electrically connected between a source node or a drain node of the driving transistor and a reference voltage line.

The drive voltage supply circuit supplies a first drive voltage to the display panel in a display driving period, supplies a second drive voltage lower than the first drive voltage to the display panel in a deterioration sensing period, and discharges the first drive voltage supplied to the display panel between the display driving period and the deterioration sensing period.

According to another aspect of the present disclosure, there is provided a display panel including: a plurality of gate lines; a plurality of data lines; a plurality of subpixels that are defined in areas in which the gate lines and the data lines intersect each other; and at least one drive voltage line. Each of the plurality of subpixels includes an organic light emitting diode, a driving transistor that drives the organic light emitting diode, a switching transistor that is electrically connected between a gate node of the driving transistor and the corresponding data line, and a sensing transistor that is electrically connected between a source node or a drain node of the driving transistor and a reference voltage line.

In this display panel, the at least one drive voltage line is supplied with a first drive voltage in a display driving period, is supplied with a second drive voltage lower than the first drive voltage in a deterioration sensing period, and slowly discharges the first drive voltage between the display driving period and the deterioration sensing period.

According to another aspect of the present disclosure, there is provided a drive voltage supply circuit including: a drive voltage output terminal that is electrically connected to a drive voltage line; a first drive voltage output circuit that is electrically connected between the drive voltage output terminal and an external power supply and outputs a first drive voltage to the drive voltage output terminal in a display driving period; a second drive voltage output circuit that is electrically connected to the drive voltage output terminal and outputs a second drive voltage lower than the first drive voltage to the drive voltage output terminal in a deterioration sensing period; and a discharge circuit that is electrically connected between the drive voltage output terminal and a ground and discharges the first drive voltage supplied to the drive voltage line between the display driving period and the deterioration sensing period.

According to the aspects of the present disclosure, it is possible to measure deterioration of an organic light emitting diode and to perform compensation based on the measured deterioration by sensing a variation in a quantity of electric charge which is charged depending on a current flowing in the organic light emitting diode in each subpixel in a deterioration sensing period.

According to the aspects of the present disclosure, it is possible to enable accuracy sensing of deterioration of an organic light emitting diode on the basis of a variation in a quantity of electric charge charged in the organic light emitting diode by decreasing a drive voltage which is supplied to a display panel in a deterioration sensing period of the organic light emitting diode.

According to the aspects of the present disclosure, it is possible to prevent damage of the drive voltage supply circuit and to supply drive voltages required for display driving and deterioration sensing by controlling a discharge speed of a drive voltage supplied to the display panel in the display driving period and the deterioration sensing period.

It is also possible to enable the drive voltage supply circuit to stably supply a drive voltage by maintaining the discharge circuit of the drive voltage supply circuit in the OFF state in a period in which a drive voltage for display driving is supplied.

BRIEF DESCRIPTION OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure.

In the drawings.

DETAILED DESCRIPTION

Figure 1:
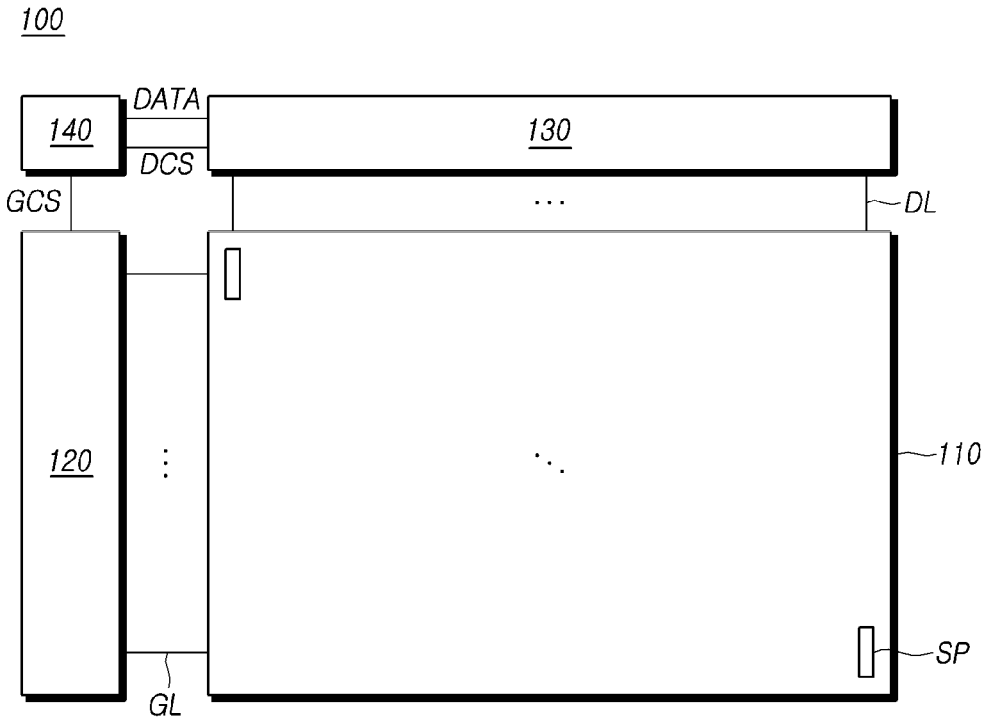
FIG. 1 is a diagram schematically illustrating a configuration of a display device according to the present disclosure.

Hereinafter, some aspects of the present disclosure will be described in details with reference to the accompanying drawings. In describing the disclosure with reference to the accompanying drawings, the same elements will be referred to by the same reference numerals or signs regardless of the drawing numbers. When it is determined that detailed description of known configurations or functions involved in the disclosure makes the gist of the disclosure obscure, the detailed description thereof will not be made.

Terms such as first, second, A, B, (a), and (b) can be used to describe elements of the disclosure. These terms are merely used to distinguish one element from another element and the essence, order, sequence, number, or the like of the elements is not limited to the terms. If it is mentioned that an element is "linked," "coupled," or "connected" to another element, it should be understood that the element can be directly coupled or connected to another element or still another element may be "interposed" therebetween or the elements may be "linked," "coupled," or "connected" to each other with still another element interposed therebetween.

FIG. 1 is a diagram schematically illustrating a configuration of a display device 100 according to aspects of the present disclosure.

Referring to FIG. 1, the display device 100 according to the aspects of the disclosure includes a display panel 110 in which a plurality of subpixels SP are arranged and a gate driving circuit 120, a data driving circuit 130, and a controller 140 that are used to drive the display panel 110.

In the display panel 110, a plurality of gate lines GL and a plurality of data lines DL are arranged and subpixels SP are arranged at areas in which the gate lines GL and the data lines DL intersect each other.

The gate driving circuit 120 is controlled by the controller 140 and serves to sequentially output a scan signal to the plurality of gate lines GL arranged in the display panel 110 and to control driving timings of the plurality of subpixels SP.

The gate driving circuit 120 includes one or more gate driver integrated circuits GDIC and may be disposed on only one side or both sides of the display panel 110 depending on a driving system thereof. Alternatively, the gate driving circuit 120 may be incorporated in a bezel area of the display panel 110 in the form of gate in panel (GIP).

The data driving circuit 130 receives image data from the controller 140 and converts the image data into a data voltage of an analog type. Then, the data driving circuit 130 outputs the data voltage to the data lines DL at the timing at which a scan signal is supplied via the gate lines GL such that the subpixels SP express brightness based on the image data.

The data driving circuit 130 includes one or more source driver integrated circuits SDIC.

The controller 140 supplies various control signals to the gate driving circuit 120 and the data driving circuit 130 and controls the gate driving circuit 120 and the data driving circuit 130.

The controller 140 causes the gate driving circuit 120 to output a scan signal at a timing which is realized in each frame and serves to convert image data received from the outside into a data signal format which is used in the data driving circuit 130 and to output the converted image data to the data driving circuit 130.

The controller 140 receives various timing signals including a vertical synchronization signal VCYNC, a horizontal synchronization signal HSYNC, an input data enable signal DE, and a clock signal CLK from the outside (for example, a host system).

The controller 140 generates various control signals using various timing signals received from the outside and outputs the generated control signals to the gate driving circuit 120 and the data driving circuit 130.

For example, the controller 140 outputs various gate control signals including a gate start pulse GSP, a gate shift clock GSC, and a gate output enable signal GOE in order to control the gate driving circuit 120.

Here, the gate start pulse GSP controls an operation start timing of one or more gate driver integrated circuits GDIC of the gate drive circuit 120. The gate shift clock GSC is a clock signal which is input commonly to the one or more gate driver integrated circuits GDIC and controls a shift timing of a scan signal. The gate output enable signal GOE designates timing information of the one or more gate driver integrated circuits GDIC.

The controller 140 outputs various data control signals DCS including a source start pulse SSP, a source sampling clock SSC, and a source output enable signal SOE in order to control the data drive circuit 130.

Here, the source start pulse SSP controls a data sampling start timing of one or more source driver integrated circuits of the data drive circuit 130. The source sampling clock SSC is a clock signal for controlling sampling timings of data in the one or more source driver integrated circuits. The source output enable signal SOE controls an output timing of the data drive circuit 130.

The display device 100 may further include a power supply management integrated circuit that supplies various voltages or currents to the display panel 110, the gate drive circuit 120, the data drive circuit 130, and the like or controls various voltage or currents to be supplied.

Each sub pixel SP is defined by intersection of one gate line GL and one data line DL and a light emitting element may be disposed each subpixel SP.

For example, the display device 100 includes a light emitting element such as a light emitting diode LED or an organic light emitting diode OLED in each subpixel and can display an image by controlling a current flowing in the light emitting element depending on a data voltage.

Figure 2:
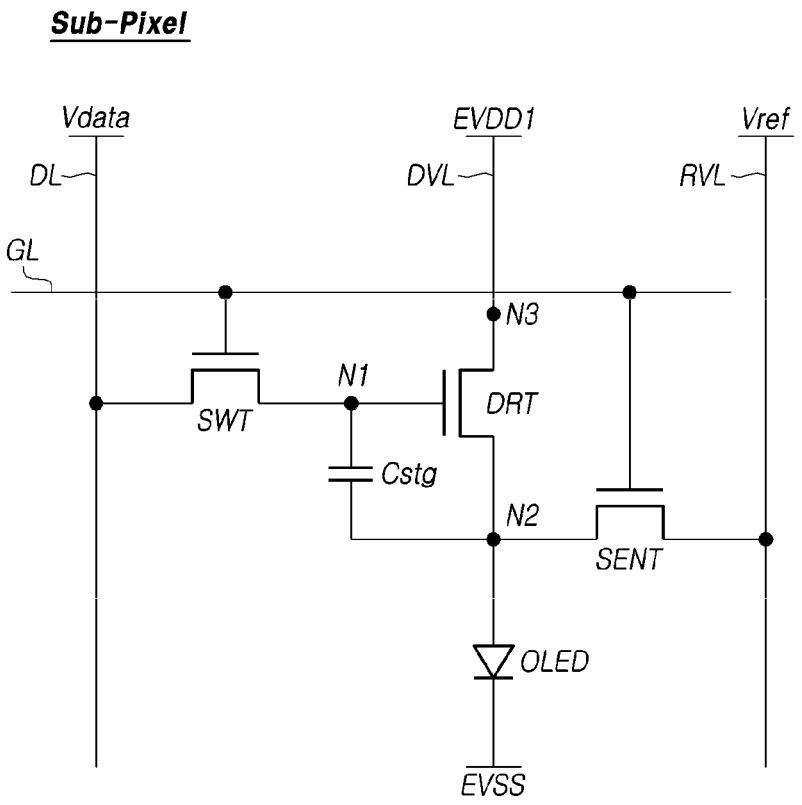
FIG. 2 is a diagram illustrating an example of a circuit structure of a subpixel in the display device according to the present disclosure.

FIG. 2 is a diagram illustrating an example of a circuit structure of a subpixel SP in the display device 100 according to the aspects of the disclosure.

Referring to FIG. 2, each subpixel SP disposed in the display device 100 according to the aspects of the disclosure includes one or more transistors and capacitors and an organic light emitting diode OLED can be disposed as a light emitting diode.

For example, each subpixel SP includes a driving transistor DRT, a switching transistor SWT, a sensing transistor SENT, a storage capacitor Cstg, and an organic light emitting diode OLED.

The driving transistor DRT includes a first node N1, a second node N2, and a third node N3.

The first node N1 of the driving transistor DRT is supplied with a data voltage Vdata via a data line DL when the switching transistor SWT is turned on and may be a gate node.

The second node N2 of the driving transistor DRT is electrically connected to an anode electrode of the organic light emitting diode OLED and may be a source node or a drain node.

The third node N3 of the driving transistor DRT is electrically connected to a drive voltage line DVL supplied with a drive voltage EVDD and may be drain node or a source node.

Here, a first drive voltage EVDD1 required for display driving can be supplied to the drive voltage line DVL in a display driving period. For example, the first drive voltage EVDD1 may be 27 V.

The switching transistor SWT is electrically connected between the first node N1 of the driving transistor DRT and the data line DL and operates in response to a scan signal supplied to the gate line GL. The switching transistor SWT controls the voltage of the gate node of the driving transistor DRT by applying a data voltage Vdata supplied via the data line DL to the gate node of the driving transistor DRT.

The sensing transistor SENT is electrically connected between the second node N2 of the driving transistor DRT and a reference voltage line RVL and operates in response to a scan signal supplied via the gate line GL. The sensing transistor SENT causes a reference voltage Vref supplied via the reference voltage line RVL to be supplied to the second node N2 of the driving transistor DRT.

That is, a current for driving the organic light emitting diode OLED can be supplied by controlling the voltage of the first node N1 and the voltage of the second node N2 of the driving transistor DRT by controlling the switching transistor SWT and the sensing transistor SENT.

The switching transistor SWT and the sensing transistor SENT may be connected to the same gate line GL or may be connected to different gate lines GL. FIG. 2 illustrates an example of a structure in which the switching transistor SWT and the sensing transistor SENT are connected to the same gate line GL. An aperture ratio of the subpixel SP can be improved by controlling the switching transistor SWT and the sensing transistor SENT via one gate line GL.

The transistors disposed in the subpixel SP are of n-type. In some cases, each subpixel SP may include p-type transistors.

The storage capacitor Cstg is electrically connected between the first node N1 and the second node N2 of the driving transistor DRT and holds a data voltage Vdata during one frame.

The storage capacitor Cstg may be connected between the first node N1 and the third node N3 of the driving transistor DRT depending on the type of the driving transistor DRT.

An anode electrode of the organic light emitting diode OLED can be electrically connected to the second node N2 of the driving transistor DRT. A base voltage EVSS can be supplied to a cathode electrode of the organic light emitting diode OLED.

The organic light emitting diode OLED emits light depending on a current which is supplied by operation of the driving transistor DRT and allows the subpixel SP to express brightness corresponding to image data.

Here, the organic light emitting diode OLED can deteriorate with the elapse of time. The organic light emitting diode OLED may not express luminance corresponding to a data voltage Vdata which is supplied to the subpixel Sp due to the deterioration. Luminance unevenness may occur due to a difference in deterioration between the organic light emitting diodes OLED included in the subpixels SP.

In the aspects of the disclosure, it is possible to prevent luminance unevenness due to a deterioration difference and to allow the organic light emitting diodes OLED to express luminance corresponding to the data voltage Vdata by sensing deterioration of the organic light emitting diodes OLED disposed in the subpixels SP and perform compensation based on the deterioration.

Figure 3:
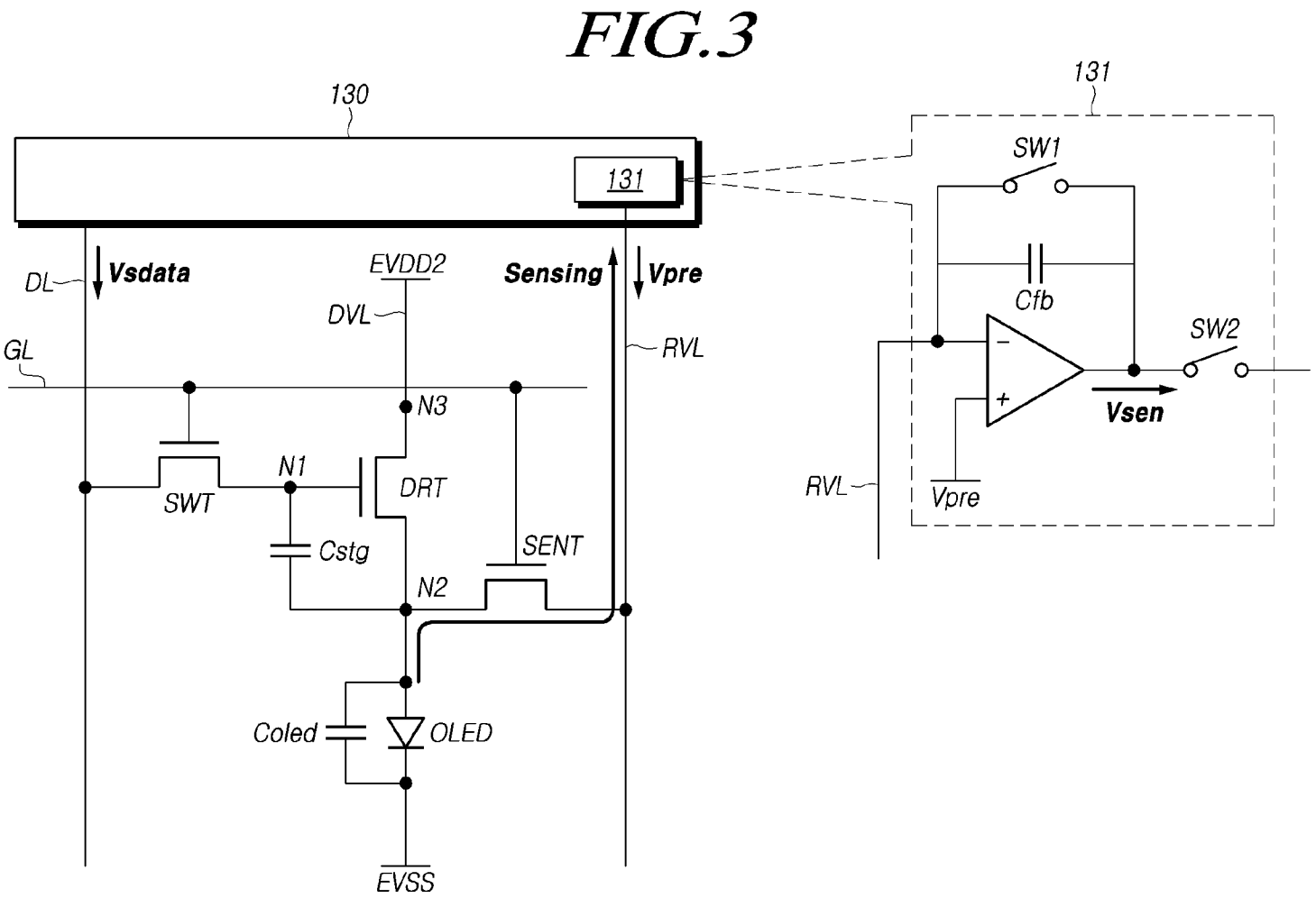
FIG. 3 is a diagram illustrating an example of a system that senses deterioration of a subpixel in the display device according to the present disclosure.

FIG. 3 is a diagram illustrating an example of a system that senses deterioration of a subpixel SP in the display device 100 according to the aspects of the disclosure.

Referring to FIG. 3, the display device 100 according to the aspects of the disclosure can cause a current to flow in the organic light emitting diodes OLED by supplying a sensing data voltage Vsdata to the subpixels SP in a deterioration sensing period. Deterioration of each organic light emitting diode OLED can be measured by detecting a variation in a quantity of electric charge charged in a parasitic capacitor Coled of the organic light emitting diode OLED.

Deterioration sensing can be performed in a period different from the display driving period. Deterioration sensing can be performed, for example, before the display device 100 is turned on to start display driving or after the display device 100 is turned off. Alternatively, deterioration sensing may be performed in a horizontal blank period or a vertical blank period or deterioration sensing may be performed in response to an input by a user.

Deterioration sensing can be performed, for example, by a sensing circuit 131 which is included in the data driving circuit 130.

Specifically, the data driving circuit 130 supplies a sensing data voltage Vsdata via the data lines DL in the deterioration sensing period and supplies a sensing reference voltage Vpre via the reference voltage line RVL. Accordingly, since a voltage difference is generated between the first node N1 and the second node N2 of the driving transistor DRT, a current can be supplied to the organic light emitting diode OLED and the parasitic capacitor Coled of the organic light emitting diode OLED can be charged with electric charge.

Here, a second drive voltage EVDD2 lower than the first drive voltage EVDD1, which is supplied via the drive voltage line DVL in the display driving period, in the deterioration sensing period can be supplied.

The second drive voltage EVDD2 may be, for example, 10 V. By supplying the second drive voltage EVDD2 lower than the first drive voltage EVDD1 in the deterioration sensing period, the voltage of the anode electrode of the organic light emitting diode OLED can be kept constant regardless of deterioration of the organic light emitting diode OLED.

That is, by measuring a variation in a quantity of electric charge charged depending on a current flowing in the organic light emitting diode OLED in a state in which the voltage of the anode electrode of the organic light emitting diode OLED is fixed, it is possible to accurately sense a degree of deterioration of the organic light emitting diode OLED.

The sensing circuit 131 senses a quantity of electric charge charged in the parasitic capacitor Voled of the organic light emitting diode OLED and outputs a sensing voltage Vsen corresponding to the sensed quantity of electric charge. The output sensing voltage Vsen can be transmitted to the controller 140, and the controller 140 determines a degree of deterioration of the organic light emitting diode OLED from the sensing voltage Vsen. By supplying a data voltage Vdata, which has been compensated for due to deterioration, to the corresponding subpixel Sp, the subpixel SP can express luminance corresponding to the data voltage Vdata and it is possible to prevent luminance unevenness due to a difference in deterioration.

The sensing circuit 131 can have various structures and can be constituted by, for example, a feedback capacitor Cfb. The sensing circuit 131 can include a first switch SW1 for initializing the feedback capacitor Cfb and a second switch SW2 for sampling the sensing voltage Vsen.

In the amplifier, the sensing reference voltage Vpre is supplied to a (+) input terminal and a (−) input terminal is connected to the reference voltage line RVL. The feedback capacitor Cfb can be electrically connected between the (−) input terminal and an output terminal of the amplifier.

Accordingly, electric charge charged in the parasitic capacitor Coled of the organic light emitting diode OLED is charged in the feedback capacitor Cfb and a variation in the quantity of electric charge charged in the parasitic capacitor Coled of the organic light emitting diode OLED due to deterioration of the organic light emitting diode OLED can be sensed.

Here, since the amplifier outputs a value in the (−) direction as the quantity of electric charge charged in the feedback capacitor Cfb increases, the sensing voltage Vsen which is higher than the sensing voltage Vsen before deterioration can be output when the quantity of electric charge charged in the parasitic capacitor Coled of the organic light emitting diode OLED decreases due to deterioration of the organic light emitting diode OLED.

Figure 4:
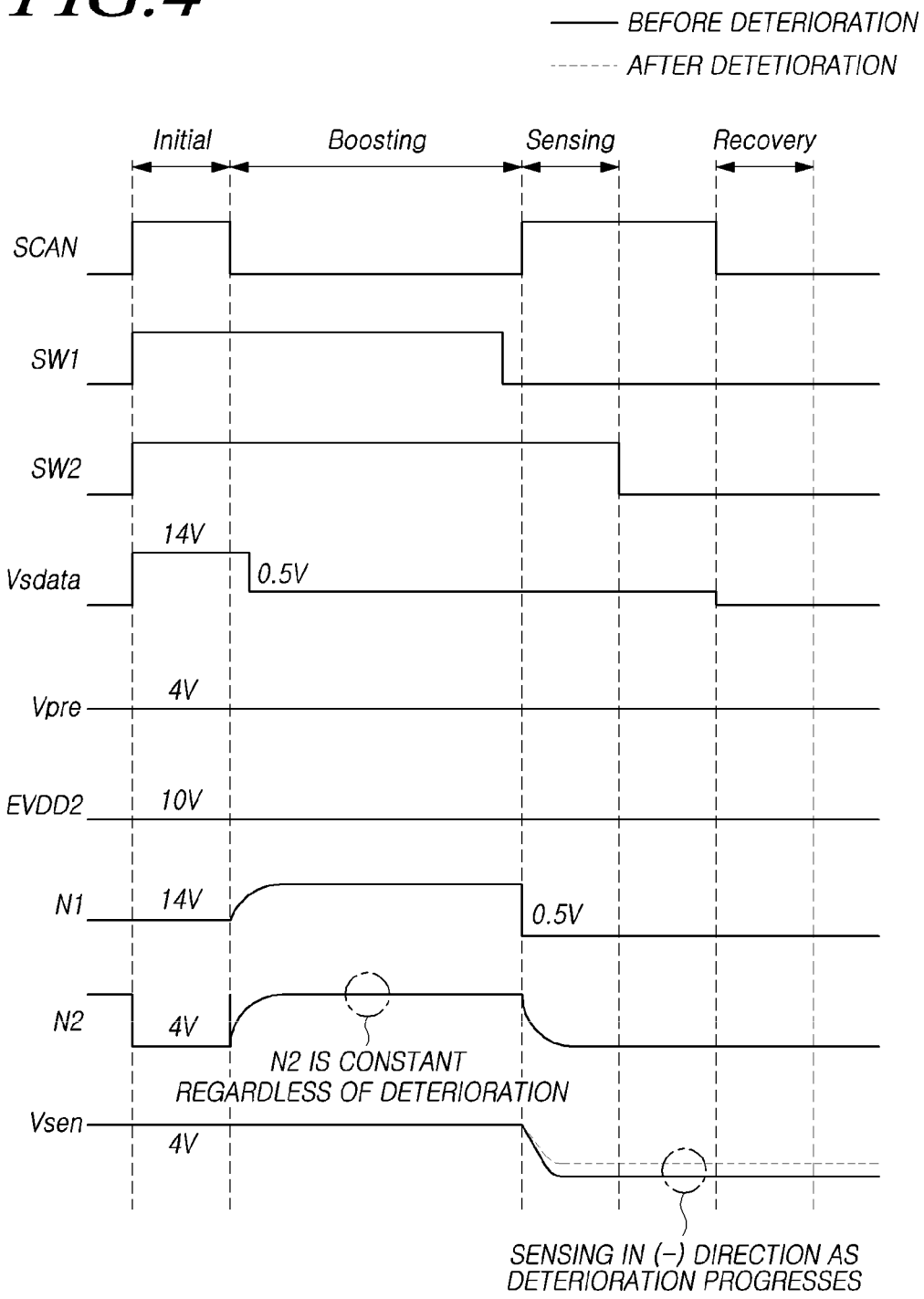
FIG. 4 is a diagram illustrating an example of deterioration sensing timings of the subpixel illustrated in FIG. 3.

FIG. 4 is a diagram illustrating an example of deterioration sensing timings of the subpixel SP illustrated in FIG. 3.

Referring to FIG. 4, the deterioration sensing period includes an initialization period Initial, a boosting period Boosting, a sensing period Sensing, and a recovery period Recovery.

The initialization period Initial is a period in which a voltage for sensing deterioration of the organic light emitting diode OLED is charged, a scan signal with a high level is supplied to the gate line, and the first switch SW1 and the second switch SW2 of the sensing circuit 131 are kept in the turned-on state.

A sensing data voltage Vsdata is supplied to the data line DL, and the sensing reference voltage Vpre is supplied to the reference voltage line RVL. Accordingly, the first node N1 of the driving transistor DRT is supplied with the sensing data voltage Vsdata and the second node N2 of the driving transistor DRT is supplied with the sensing reference voltage Vpre.

Here, the drive voltage EVDD supplied to the drive voltage line DVL can be the second drive voltage EVDD2 which is lower than the first drive voltage EVDD1 supplied in the display driving period.

By lowering the level of the drive voltage EVDD supplied in the deterioration sensing period and keeping the voltage level of the anode electrode of the organic light emitting diode OLED, that is, the second node N2 of the driving transistor DRT, constant, a quantity of electric charge charged in the parasitic capacitor Coled of the driving transistor DRT can be accurately sensed.

The boosting period Boosting is a period in which the parasitic capacitor Coled is charged with electric charge by causing a current to flow in the organic light emitting diode OLED when application of a voltage for deterioration sensing is completed.

In the boosting period Boosting, a signal with a low level is supplied to the gate line GL. The first switch SW1 and the second switch SW2 of the sensing circuit 131 is kept in the turned-on state, and the first switch SW1 can be turned off before the sensing period Sensing is started.

When a scan signal with a low level is supplied to the gate line GL, the switching transistor SWT and the sensing transistor SENT are turned off and thus the first node N1 and the second node N2 of the driving transistor DRT becomes a floating state. Accordingly, the voltages of the first node N1 and the second node N2 increase gradually.

A current flows into the organic light emitting diode OLED and the parasitic capacitor Coled of the organic light emitting diode OLED is charged with electric charge.

Here, since the level of the drive voltage EVDD has been lowered to the second drive voltage EVDD2, the voltage of the second node N2 of the driving transistor DRT becomes constant and the parasitic capacitor Coled of the organic light emitting diode OLED can be charged in a state in which the voltage of the anode electrode of the organic light emitting diode OLED is constant.

Since the quantity of electric charge charged in the parasitic capacitor Coled can decrease as deterioration of the organic light emitting diode OLED processes, it is possible to detect a variation in the quantity of electric charge and to sense deterioration of the organic light emitting diode OLED.

The sensing period Sensing is a period in which electric charge charged in the parasitic capacitor Coled is detected after the parasitic capacitor Coled of the organic light emitting diode OLED is charged.

In the sensing period Sensing, a scan signal with a high level is supplied to the gate line and the first switch SW1 of the sensing circuit 131 is kept in the turned-off state. The second switch SW2 is kept in the turned-on state.

Since a voltage with such a level to turn off the driving transistor DRT is supplied via the data line DL and the sensing transistor SENT is turned on, the feedback capacitor Cfb of the sensing circuit 131 is charged with the electric charge charged in the parasitic capacitor Coled of the organic light emitting diode OLED via the reference voltage line RVL.

The amplifier of the sensing circuit 131 outputs a value in the (−) direction as the quantity of electric charge charged in the feedback capacitor Cfb increases. Accordingly, when the quantity of electric charge charged in the parasitic capacitor Coled decreases due to deterioration of the organic light emitting diode OLED, the amplifier outputs a sensing voltage Vsen which is higher than that before deterioration due to the decrease in the quantity of electric charge charged in the feedback capacitor Cfb.

The recovery period Recovery is a predetermined period before the deterioration sensing period has ended and before display driving is started and is a period in which voltages supplied to the voltage lines are reset for display driving after deterioration sensing has been performed.

Figure 5:
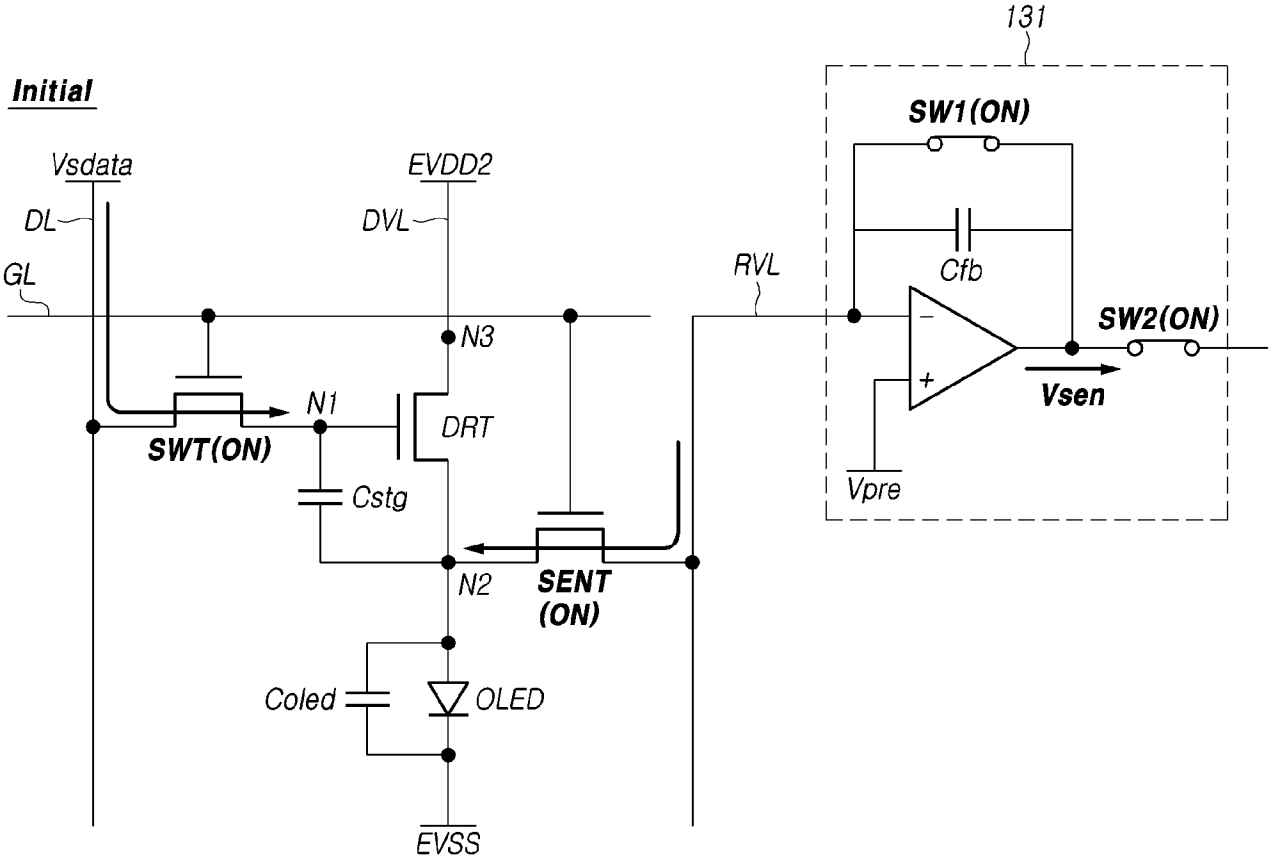
FIGS. 5 to 7 are diagrams illustrating examples of the process of sensing deterioration of the subpixel illustrated in FIG. 3.
Figure 6:
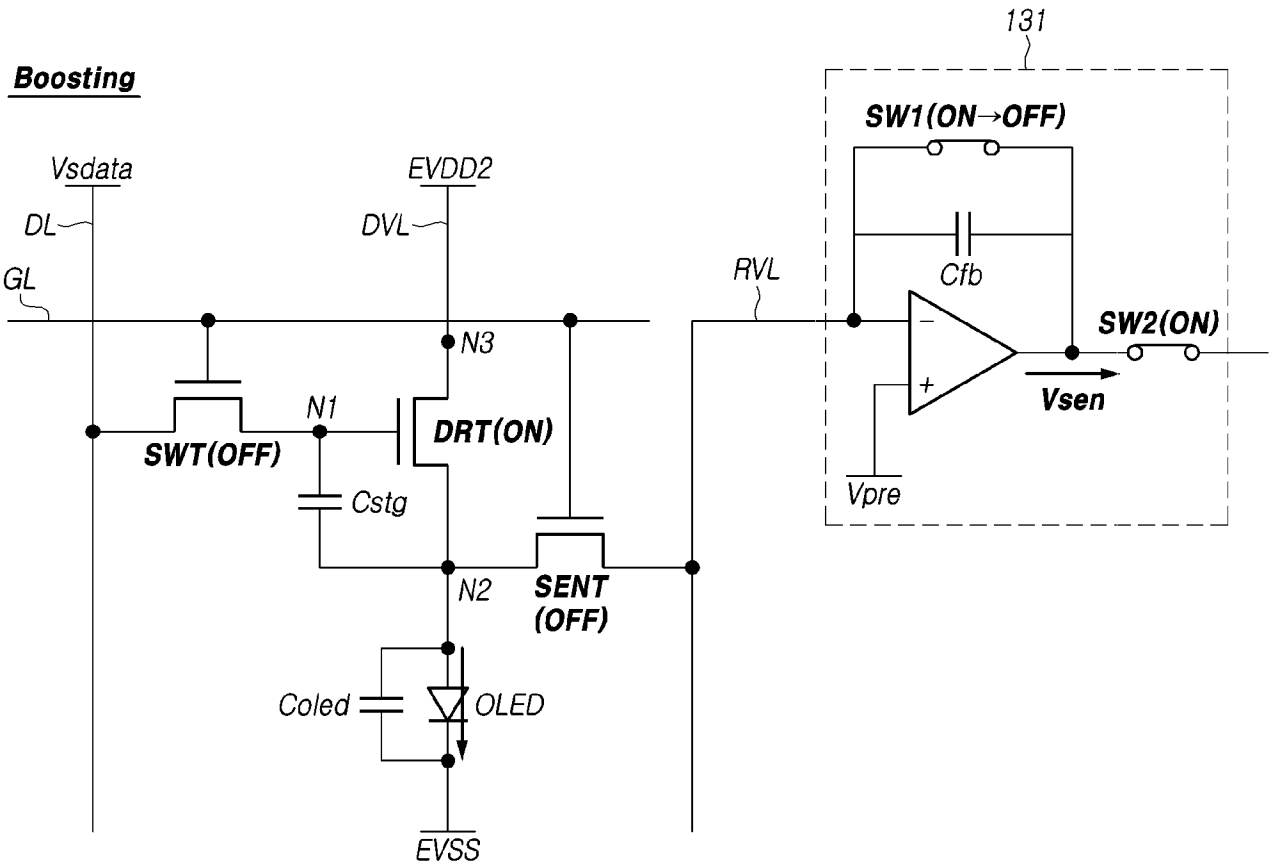
Figure 7:
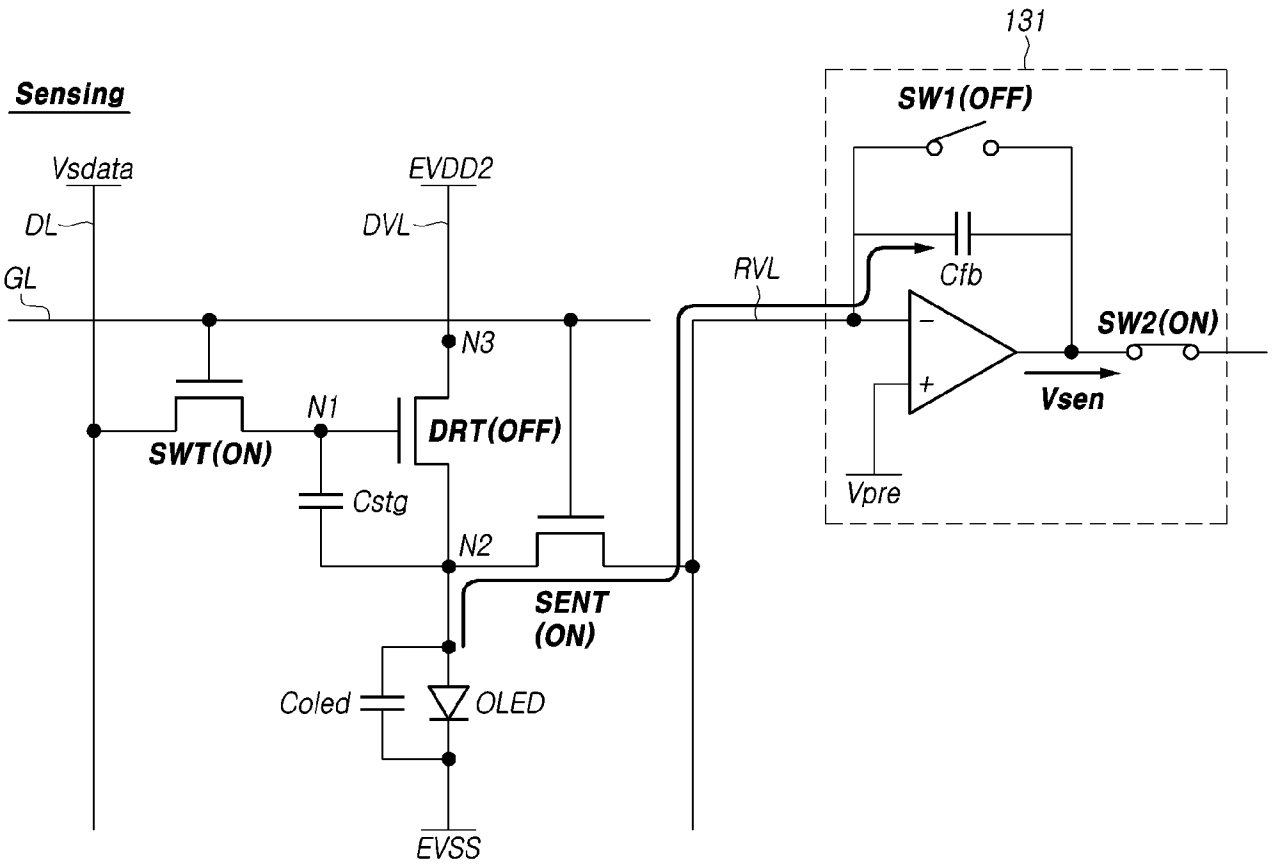

FIGS. 5 to 7 are diagrams illustrating examples of the process of sensing deterioration of the subpixel illustrated in FIG. 3 and illustrating states of the subpixel SP and the sensing circuit 131 at the timings illustrated in FIG. 4.

Referring to FIG. 5, the switching transistor SWT and the sensing transistor SENT are turned on in the initialization period Initial.

When the switching transistor SWT is turned on, the sensing data voltage Vsdata is supplied to the first node N1 of the driving transistor DRT. The sensing data voltage Vsdata may be, for example, 14 V.

When the sensing transistor SENT is turned on, the sensing reference voltage Vpre is supplied to the second node N2 of the driving transistor DRT. The sensing reference voltage Vpre may be, for example, 4 V.

The second drive voltage EVDD2 lower than the first drive voltage EVDD1 which is supplied in the display driving period is supplied to the drive voltage line DVL. The second drive voltage EVDD2 may be, for example, 10 V.

Here, the first switch SW1 of the sensing circuit 131 is kept in the turned-on state to initialize the feedback capacitor Cfb.

Referring to FIG. 6, the switching transistor SWT and the sensing transistor SENT are turned off in the boosting period Boosting.

Since the switching transistor SWT and the sensing transistor SENT are turned off, the voltages of the first node N1 and the second node N2 of the driving transistor DRT increases gradually. Then, the driving transistor DRT is turned on and a current flows in the organic light emitting diode OLED.

Here, since the second drive voltage EVDD2 is supplied to the third node N3 of the driving transistor DRT, the operating voltage of the organic light emitting diode OLED, that is, the voltage of the second node N2 of the driving transistor DRT, is kept at a constant level regardless of deterioration of the organic light emitting diode OLED.

When a current flows in the organic light emitting diode OLED, the parasitic capacitor Coled of the organic light emitting diode OLED is charged.

Referring to FIG. 7, the switching transistor SWT and the sensing transistor SENT are turned on in the sensing period Sensing. Then, a voltage with such a level to turn off the driving transistor DRT is supplied to the data line DL. For example, the voltage may be 0.5 V.

Accordingly, the driving transistor DRT is in the turned-off state in the sensing period Sensing. Since the first switch SW1 of the sensing circuit 131 is in the turned-off state, the feedback capacitor Cfb of the sensing circuit 131 can be charged with the electric charge charged in the parasitic capacitor Coled of the organic light emitting diode OLED via the reference voltage line RVL.

The amplifier of the sensing circuit 131 outputs a sensing voltage Vsen corresponding to the quantity of electric charge charged in the feedback capacitor Cfb and can sense deterioration of the organic light emitting diode OLED using the value of the output sensing voltage Vsen.

Figure 8:
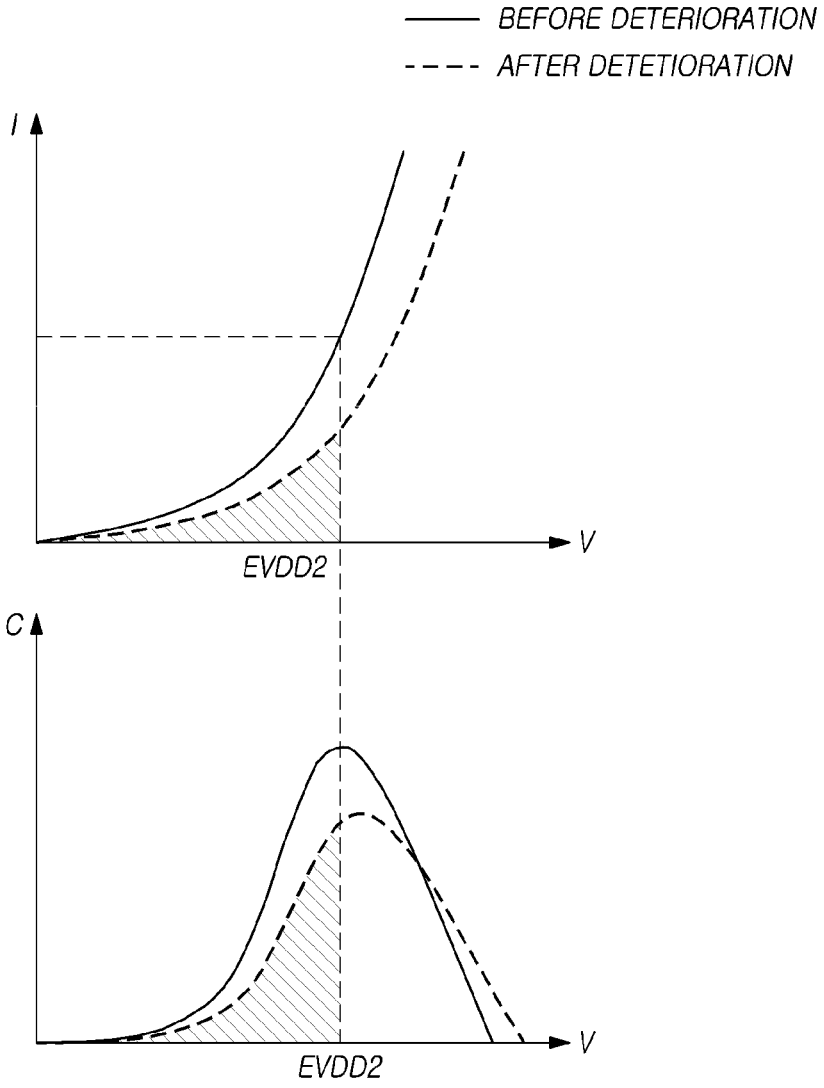
FIG. 8 is a diagram illustrating an example of a quantity of electric charge which is charged in an organic light emitting diode in the process of sensing deterioration before and after deterioration of the subpixel illustrated in FIG. 3.

FIG. 8 is a diagram illustrating an example of a quantity of electric charge which is charged in an organic light emitting diode OLED in the process of sensing deterioration before and after deterioration of the subpixel illustrated in FIG. 3.

Referring to FIG. 8, as deterioration of the organic light emitting diode OLED progresses, a current flowing therein can decrease depending on the voltage supplied to the organic light emitting diode OLED. The quantity of electric charge charged in the parasitic capacitor Coled of the organic light emitting diode OLED can decrease due to the decrease of the current.

When deterioration of the organic light emitting diode OLED progresses, the operating voltage of the organic light emitting diode OLED can increase. When the operating voltage of the organic light emitting diode OLED increases, the quantity of electric charge charged in the parasitic capacitor Coled of the organic light emitting diode OLED can increase.

That is, the quantity of electric charge charged can increase depending on the current flowing in the organic light emitting diode OLED with application of a voltage thereto and thus it may be difficult to accurately sensing deterioration of the organic light emitting diode OLED.

However, according to the aspects of the disclosure, since deterioration of the organic light emitting diode OLED is sensed in a state in which the second drive voltage EVDD2 with a lowered voltage level is supplied to the drive voltage line DVL in the deterioration sensing period, a current can flow in the organic light emitting diode OLED in a state in which the operating voltage of the organic light emitting diode OLED is kept constant.

Accordingly, since the quantity of electric charge charged in the parasitic capacitor Coled of the organic light emitting diode OLED decreases as deterioration of the organic light emitting diode OLED progresses, it is possible to accurately sense a degree of deterioration of the organic light emitting diode OLED using the variation of the quantity of electric charge charged in the parasitic capacitor Coled of the organic light emitting diode OLED.

In this way, the aspects of the disclosure provides a circuit that can accurate sense deterioration of an organic light emitting diode OLED and control the drive voltages EVDD supplied in the deterioration sensing period and the display driving period.

Figure 9:
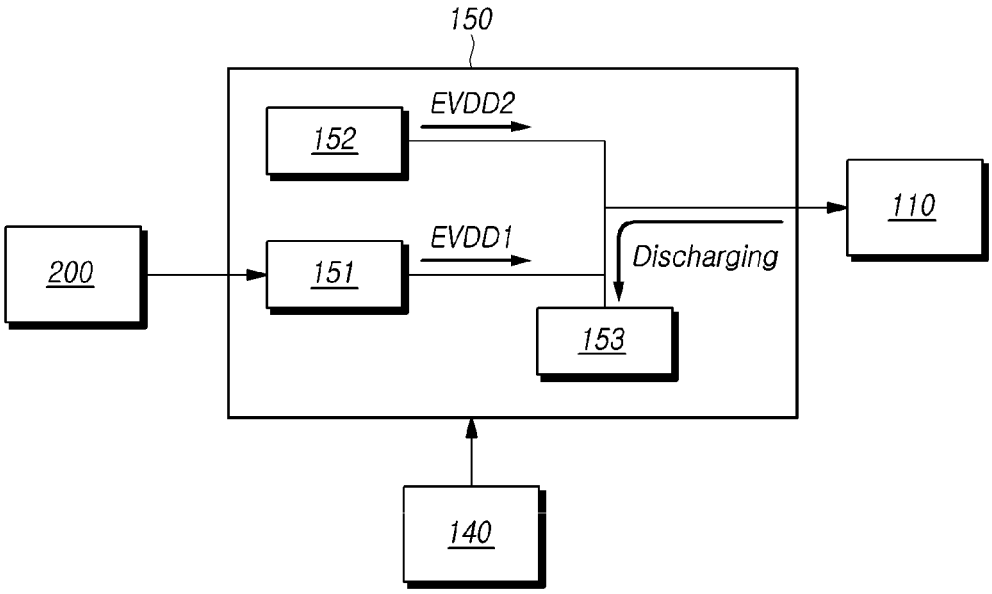
FIG. 9 is a diagram illustrating an example of a drive voltage supply circuit in the display device according to the present disclosure.

FIG. 9 is a diagram illustrating an example of the configuration of a drive voltage supply circuit 150 in the display device 100 according to the aspects of the disclosure.

Referring to FIG. 9, the drive voltage supply circuit 150 according to the aspects of the disclosure includes a first drive voltage output circuit 151 that outputs the first drive voltage EVDD1 for display driving and a second drive voltage output circuit 152 that outputs the second drive voltage EVDD2 for deterioration sensing. The drive voltage supply circuit 150 can further include a discharge circuit 153 that discharges the first drive voltage EVDD1 supplied to the display panel 110 between the display driving period and the deterioration sensing period.

The drive voltage supply circuit 150 can operate in accordance with a control signal output from the controller 140. For example, the drive voltage supply circuit 150 can be disposed in the form of a module on a control printed circuit board.

The first drive voltage output circuit 151 is supplied with source voltage from a power supply circuit 200 which is located outside the drive voltage supply circuit 150 and outputs the first drive voltage EVDD1 required for display driving. The first drive voltage output circuit 151 can operate in accordance with a control signal output from the controller 140 and supply the first drive voltage EVDD1 to the display panel 110 in the display driving period.

The second drive voltage output circuit 152 outputs the second drive voltage EVDD2 required for deterioration sensing. The second drive voltage EVDD2 may be a voltage lower than the first drive voltage EVDD1. The second drive voltage output circuit 152 includes a regulator (for example, LDO) that lowers the voltage level of the source voltage input from the outside and serves to lower the voltage level input from the outside and to output the second drive voltage EVDD2 required for deterioration sensing.

The second drive voltage output circuit 152 can operates in accordance with a control signal output from the controller 140 and supply the second drive voltage EVDD2 to the display panel 110 in the deterioration sensing period.

The discharge circuit 153 discharges the first drive voltage EVDD1 supplied to the display panel 110 between the display driving period and the deterioration sensing period.

That is, since the first drive voltage EVDD1 with a high level is to be supplied to the display panel 110 in the display driving period and the second drive voltage EVDD2 with a low level is to be supplied in the deterioration sensing period, the discharge circuit 153 discharges the first drive voltage EVDD1 supplied to the display panel 110 between the display driving period and the deterioration sensing period.

When the discharge circuit 153 discharges the first drive voltage EVDD1 supplied to the display panel 110 before performing deterioration sensing, the second drive voltage EVDD2 required for deterioration sensing can be stably supplied to the display panel 110 in the deterioration sensing period.

Figure 10:
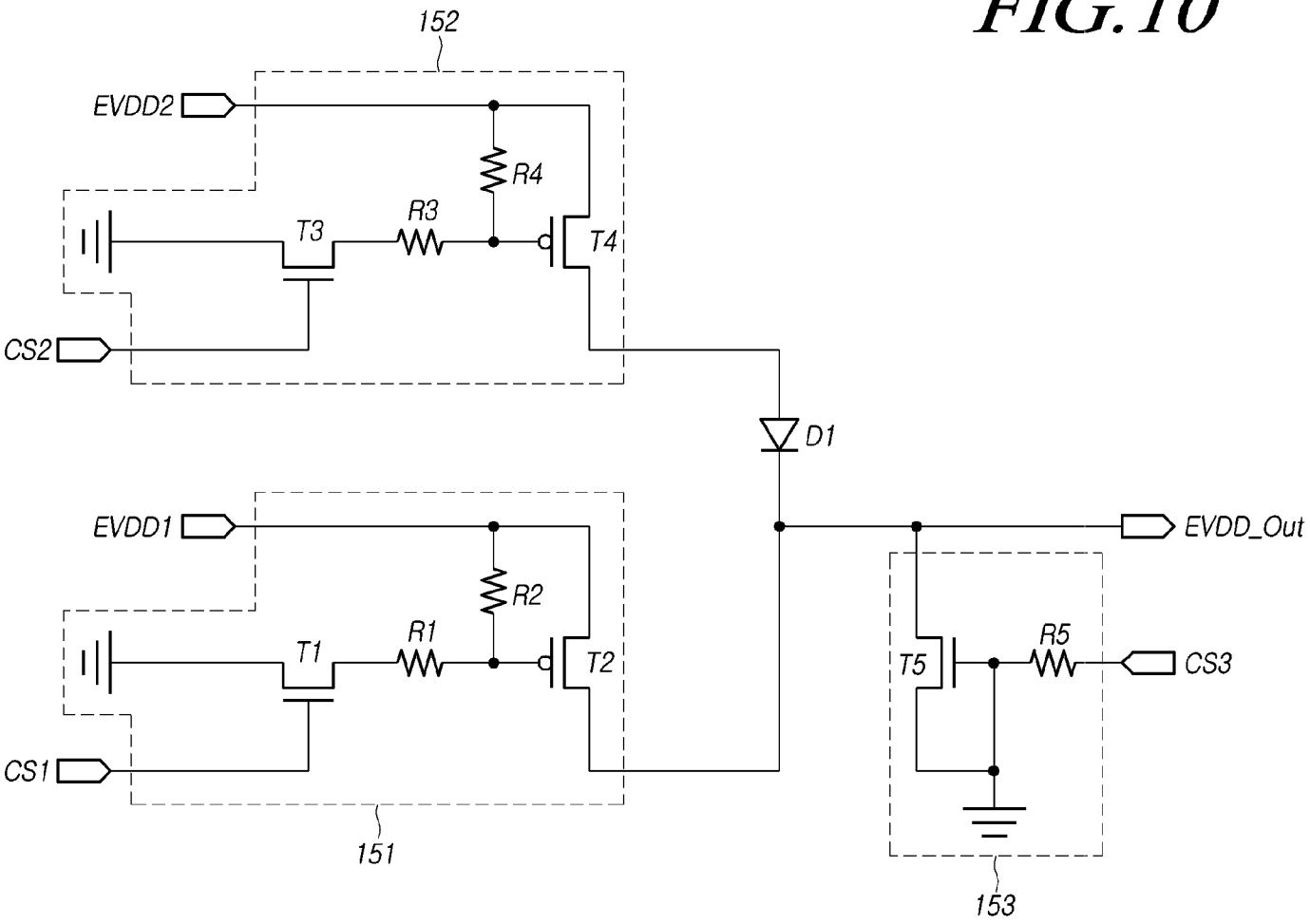
FIG. 10 is a diagram illustrating an example of a structure of the drive voltage supply circuit illustrated in FIG. 9.

FIG. 10 is a diagram illustrating an example of the structure of the drive voltage supply circuit 150 illustrated in FIG. 9.

Referring to FIG. 10, the drive voltage supply circuit 150 includes a first drive voltage output circuit 151 that outputs the first drive voltage EVDD1 to a drive voltage output terminal EVDD_Out and a second drive voltage output circuit 152 that outputs the second drive voltage EVDD2 to the drive voltage output terminal EVDD_Out. The drive voltage supply circuit 150 further includes a discharge circuit 153 that is electrically connected to the drive voltage output terminal EVDD_Out and discharges the first drive voltage EVDD1 supplied to the display panel 110.

The first drive voltage output circuit 151 may include, for example, a first transistor T1 that is controlled by a first control signal CS1 which is output from the controller 140 and a second transistor T2 that controls the output of the first drive voltage EVDD1. The first drive voltage output circuit 151 may further include a first resistor R1 that is electrically connected between gate nodes of the first transistor T1 and the second transistor T2 and a second resistor R2 that is electrically connected between an input terminal of the first drive voltage EVDD1 and the gate node of the second transistor T2.

The first transistor T1 is turned off in accordance with the first control signal CS1 output from the controller 140. When the first control signal CS1 with a high level is supplied, the first transistor T1 is turned on to allow a ground voltage to be supplied to the gate node of the second transistor T2. Here, the first control signal CS1 is also referred to as a "display control signal."

The second transistor T2 is electrically connected between the input terminal of the first drive voltage EVDD1 and the drive voltage output terminal EVDD_Out.

When the first transistor R1 is turned on and the ground voltage is supplied to the gate node of the second transistor T2, the second transistor T2 is turned on by voltage division based on the second resistor R2 and the first drive voltage EVDD1 is output to the drive voltage output terminal EVDD_Out.

Here, the first transistor T1 is an n-type transistor and the second transistor T2 is a p-type transistor, but the transistors may be of other types in some cases.

In this way, the first drive voltage output circuit 151 can receive the first control signal CS1 with a high level from the controller 140 and supply the first drive voltage EVDD1 to the display panel 110 in the display driving period and In a period other than the display driving period, the first drive voltage output circuit 151 can receive the first control signal CS1 with a low level from the controller 140, and turn off the first transistor T1 and the second transistor T2 such that the first drive voltage EVDD1 is not output to the drive voltage output terminal EVDD_Out.

The second drive voltage output circuit 152 may include, for example, a third transistor T3 that operates in accordance with a second control signal CS2 which is output from the controller 140 and a fourth transistor T4 that controls the output of the second drive voltage EVDD2. The second drive voltage output circuit 152 may further include a third resistor R3 that is electrically connected between gate nodes of the third transistor T3 and the fourth transistor T4 and a fourth resistor R4 that is electrically connected between an input terminal of the second drive voltage EVDD2 and the gate node of the fourth transistor T4.

The third transistor T3 is turned off by a third control signal CS3 output from the controller 140 and is turned on by the third control signal CS3 with a high level to allow the ground voltage to be supplied to the gate node of the fourth transistor T4. Here, the second control signal CS2 is also referred to as a "sensing control signal."

The fourth transistor T4 is electrically connected between the input terminal of the second drive voltage EVDD2 and the drive voltage output terminal EVDD_Out. When the third transistor T3 is turned on and the ground voltage is supplied to the gate node of the fourth transistor T4, the fourth transistor T4 is turned on by voltage division based on the fourth resistor R4 to allow the second drive voltage EVDD2 to be output to the drive voltage output terminal EVDD_Out.

Here, the third transistor T3 is an n-type transistor and the fourth transistor T4 is a p-type transistor, but the transistors may be of other types in some cases.

A first diode D1 can be connected between the second drive voltage output circuit 152 and the drive voltage output terminal EVDD_Out. The first diode D1 can prevent a current from flowing to the second drive voltage output circuit 152 in which the voltage level is relatively low.

The second drive voltage output circuit 152 receives the second control signal CS2 with a high level from the controller 140 and outputs the second drive voltage EVDD2 to the drive voltage output terminal EVDD_Out to enable accurate sensing of deterioration of the organic light emitting diode OLED disposed in each subpixel SP in the deterioration sensing period. In a period other than the deterioration sensing period, the second drive voltage output circuit 152 receives the second control signal CS2 with a low level such that the second drive voltage EVDD2 is not output therefrom.

The discharge circuit 153 may include a fifth transistor T5 that is electrically connected between the drive voltage output terminal EVDD_Out and the ground and operates in accordance with a third control signal CS3 which is output from the controller 140. The discharge circuit 153 may further include a fifth resistor R5 that is connected to a gate node of the fifth transistor T5.

Since the gate node of the fifth transistor T5 is electrically connected to the ground, the fifth transistor T5 is kept in the turned-off state in the display driving period or the deterioration sensing period and allows the drive voltage EVDD to be stably output to the drive voltage output terminal EVDD_Out.

When the fifth transistor T5 receives the third control signal CS3 with a high level output from the controller 140 in a period between the display driving period and the deterioration sensing period, the fifth transistor T5 is turned on to discharge the first drive voltage EVDD1 supplied to the display panel 110.

The third control signal CS3 is also referred to as a "discharge control signal" and the fifth transistor T5 is also referred to as a "discharge control transistor."

Accordingly, the fifth transistor T5 of the discharge circuit 153 is turned on in a period between the display driving period and the deterioration sensing period to discharge the first drive voltage EVDD1 supplied to the display panel 110 such that the second drive voltage EVDD2 for deterioration sensing can be supplied.

In a period other than the period for discharge, the fifth transistor T5 is kept in the turned-off state such that the first drive voltage EVDD1 or the second drive voltage EVDD2 can be stably supplied to the display panel 110.

Figure 11:
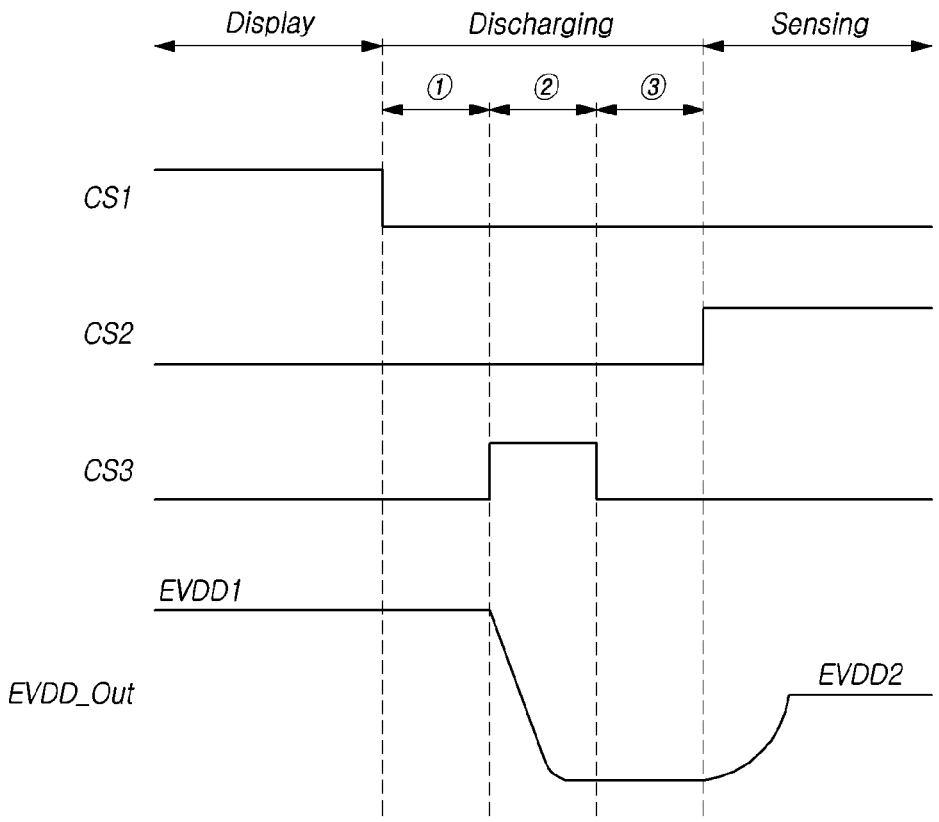
FIG. 11 is a diagram illustrating an example of operation timings of the drive voltage supply circuit illustrated in FIG. 10.

FIG. 11 is a diagram illustrating an example of an operation timing of the drive voltage supply circuit 150 illustrated in FIG. 10.

Referring to FIG. 11, the first control signal CS1 with a high level, the second control signal CS2 with a low level, and the third control signal CS3 with a low level can be supplied to the drive voltage supply circuit 150 in the display driving period.

Accordingly, the first drive voltage output circuit 151 can operate in accordance with the first control signal CS1 to supply the first drive voltage EVDD1 required for display driving to the display panel 110.

In the discharge period between the display driving period and the deterioration sensing period, the discharge circuit 153 can operate to discharge the first drive voltage EVDD1 supplied to the display panel 110.

For example, the discharge period may include three time sections. In time section (1), the first control signal CS1 with a low level is input to the first drive voltage output circuit 151. Accordingly, the first drive voltage output circuit 151 stops outputting of the first drive voltage EVDD1 and the drive voltage line DVL of the display panel 110 may be in a floating state.

In time section (2), the third control signal CS3 with a high level is input to the discharge circuit 153. Then, the first drive voltage output circuit 151 and the second drive voltage output circuit 152 receive the first control signal CS1 and the second control signal CS2 with a low level. In time section (2), since the fifth transistor T5 of the discharge circuit 153 is in the turned-on state, the first drive voltage EVDD1 supplied to the display panel 110 is discharged.

In time section (3), all of the first control signal CS1, the second control signal CS2, and the third control signal CS3 are input at a low level. By setting a predetermined time section after the first drive voltage EVDD1 has been discharged and before the second drive voltage EVDD2 is supplied, it is possible to stabilize the voltage state of the drive voltage line DVL before deterioration sensing is performed.

In this way, when discharge of the first drive voltage EVDD1 supplied to the display panel 110 has been completed in the discharge period, the second control signal CS2 with a high level is input to the second drive voltage output circuit 152 in the deterioration sensing period. The second drive voltage output circuit 152 operates in accordance with the second control signal CS2 and the second drive voltage EVDD2 is supplied to the display panel 110.

Accordingly, by performing deterioration sensing in a state in which the second drive voltage EVDD2 with a level lower than that of the first drive voltage EVDD1 is supplied, it is possible to accurately sense a degree of deterioration of an organic light emitting diode OLED.

By discharging the first drive voltage EVDD1 supplied to the display panel 110 between the display driving period and the deterioration sensing period, it is possible to stably supply the second drive voltage EVDD2 in the deterioration sensing period.

Figure 12:
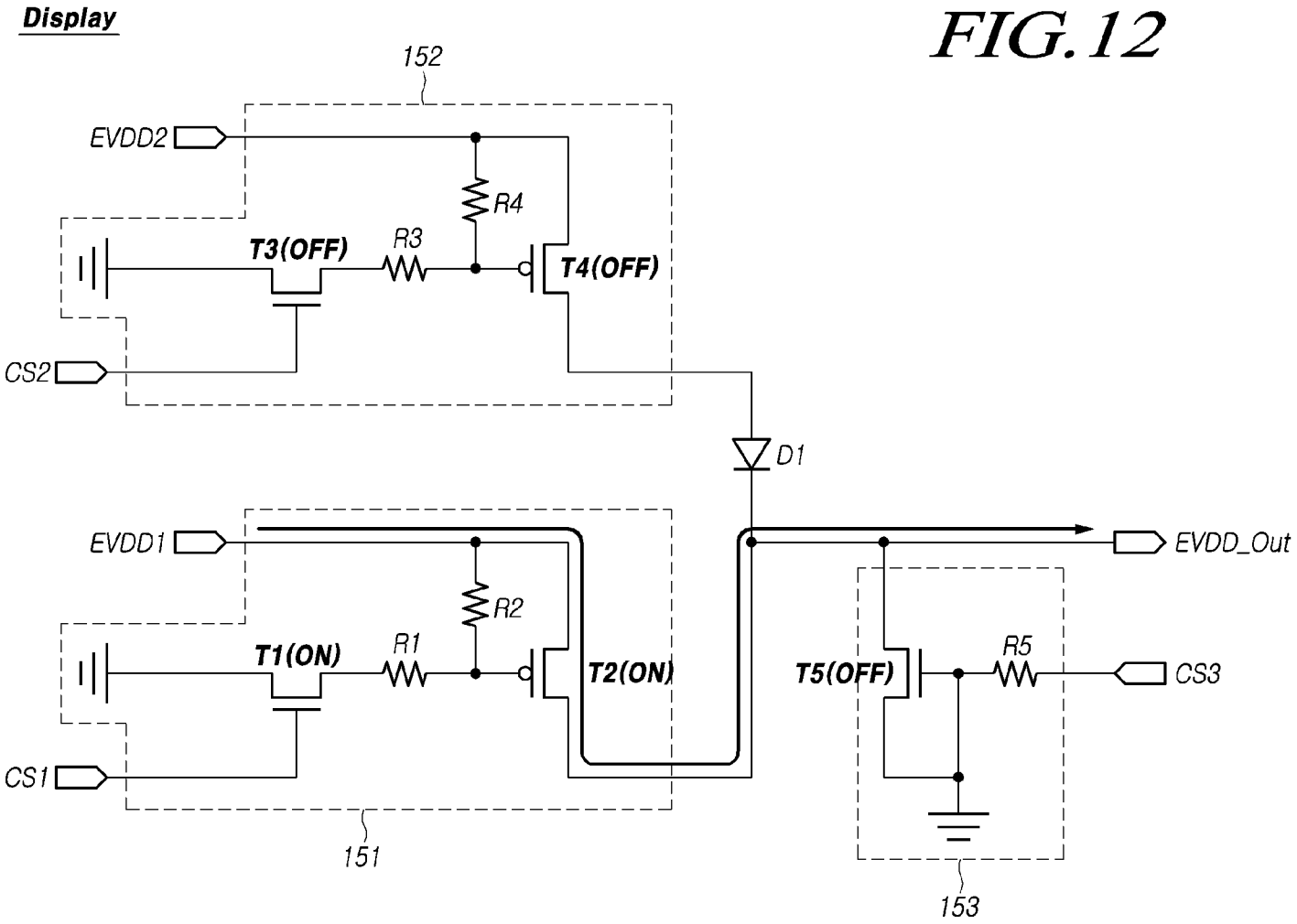
FIGS. 12 to 14 are diagrams illustrating examples of the process of operation of the drive voltage supply circuit illustrated in FIG. 10.
Figure 13:
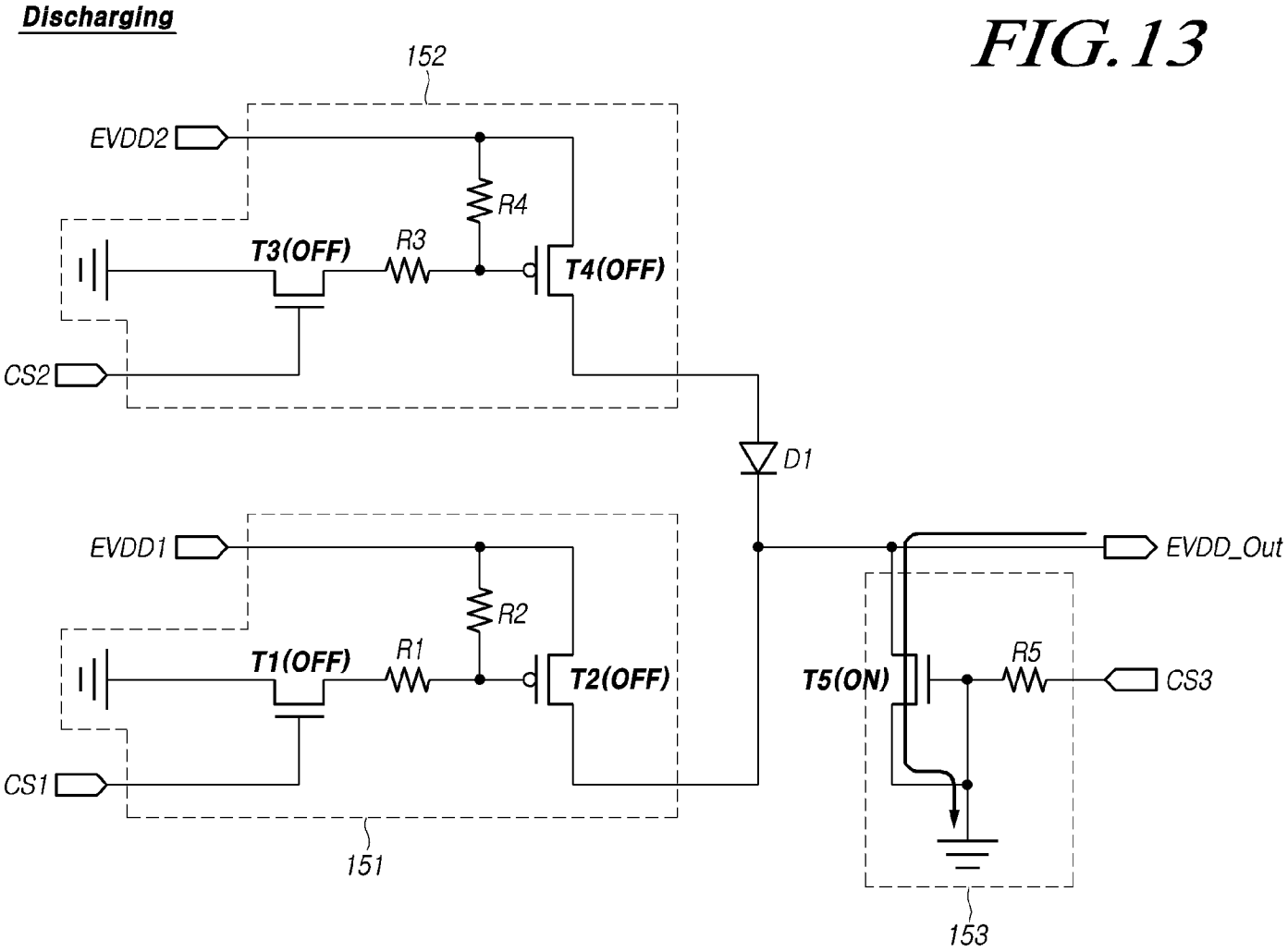
Figure 14:
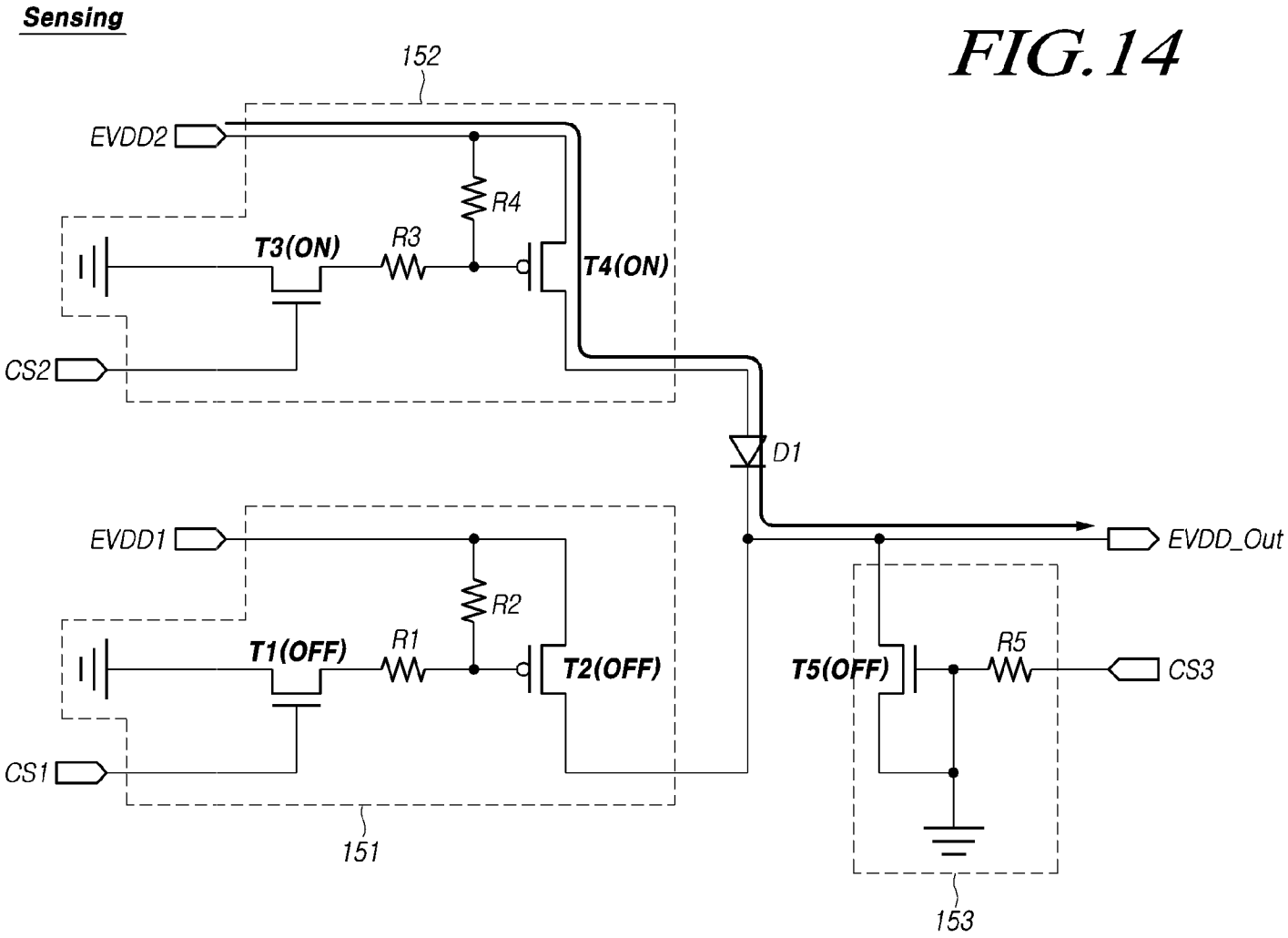

FIGS. 12 to 14 are diagrams illustrating examples of the process of operation of the drive voltage supply circuit 150 illustrated in FIG. 10.

Referring to FIG. 12, the first control signal CS1 with a high level, the second control signal CS2 with a low level, and the third control signal CS3 with a low level are input to the drive voltage supply circuit 150 in the display driving period.

Accordingly, the first transistor T1 and the second transistor T2 of the first drive voltage output circuit 151 are turned on, and the first drive voltage EVDD1 is output to the drive voltage output terminal EVDD_Out and is supplied to the display panel 110.

The third transistor T3 and the fourth transistor T4 of the second drive voltage output circuit 152 are kept in the turned-off state. The fifth transistor T5 of the discharge circuit 153 are also kept in the turned-off state and the first drive voltage EVDD1 can be stably supplied to the display panel 110 in the display driving period.

Referring to FIG. 13, the third control signal CS3 with a high level, the first control signal CS1 with a low level, and the second control signal CS2 with a low level are input to the drive voltage supply circuit 150 in the discharge period between the display driving period and the deterioration sensing period.

Accordingly, the first transistor T1 and the second transistor T2 of the first drive voltage output circuit 151 are turned off, and thus the first drive voltage EVDD1 is not output. The third transistor T3 and the fourth transistor T4 of the second drive voltage output circuit 152 are turned off, and thus the second drive voltage EVDD2 is not output.

Since the fifth transistor T5 of the discharge circuit 153 is turned on and the drive voltage output terminal EVDD_Out is electrically connected to the ground, the first drive voltage EVDD1 supplied to the display panel 110 is discharged.

This process of discharge can be performed through steps of stopping the output of the first drive voltage EVDD1, discharging the first drive voltage EVDD1 of the display panel 110, and stabilizing the drive voltage line DVL as described above.

Referring to FIG. 14, the second control signal CS2 with a high level, the first control signal CS1 with a low level, and the third control signal C3 with a low level are input to the drive voltage supply circuit 150 in the deterioration sensing period.

Accordingly, the first transistor T1 and the second transistor T2 of the first drive voltage output circuit 151 are kept in the turned-off state and the first drive voltage EVDD1 is not output. The fifth transistor T5 of the discharge circuit 153 is turned off and thus the voltage of the drive voltage output terminal EVDD_Out is not discharged to the ground.

Here, since the third transistor T3 and the fourth transistor T4 of the second drive voltage output circuit 152 are turned on, the second drive voltage EVDD2 is supplied to the drive voltage line DVL of the display panel 110.

Since the second drive voltage EVDD2 lower than the first drive voltage EVDD1 required for display driving is supplied to the drive voltage line DVL of the display panel 110, the operating voltage of the organic light emitting diode OLED can be kept constant to sense deterioration.

In this way, the drive voltage supply circuit 150 according to the aspects of the disclosure enables stable display driving and accurate deterioration sensing by supplying drive voltages with different levels in the display driving period and the deterioration sensing period.

By discharging the first drive voltage EVDD1 supplied to the display panel 110 between the display driving period and the deterioration sensing period, the second drive voltage EVDD2 can be stably supplied in the deterioration sensing period.

The second drive voltage EVDD2 required for deterioration sensing can be stably supplied through this process of discharge, but since a voltage of a high level such as the first drive voltage EVDD1 is discharged, circuit elements of the discharge circuit 153 may be damaged in the process of discharge.

The aspects of the disclosure provide the drive voltage supply circuit 150 that can discharge the first drive voltage EVDD1 supplied to the display panel 110 using the discharge circuit 153, prevent damage of the discharge circuit 153 by controlling a discharge speed, and stably supply the first drive voltage EVDD1 and the second drive voltage EVDD2.

Figure 15:
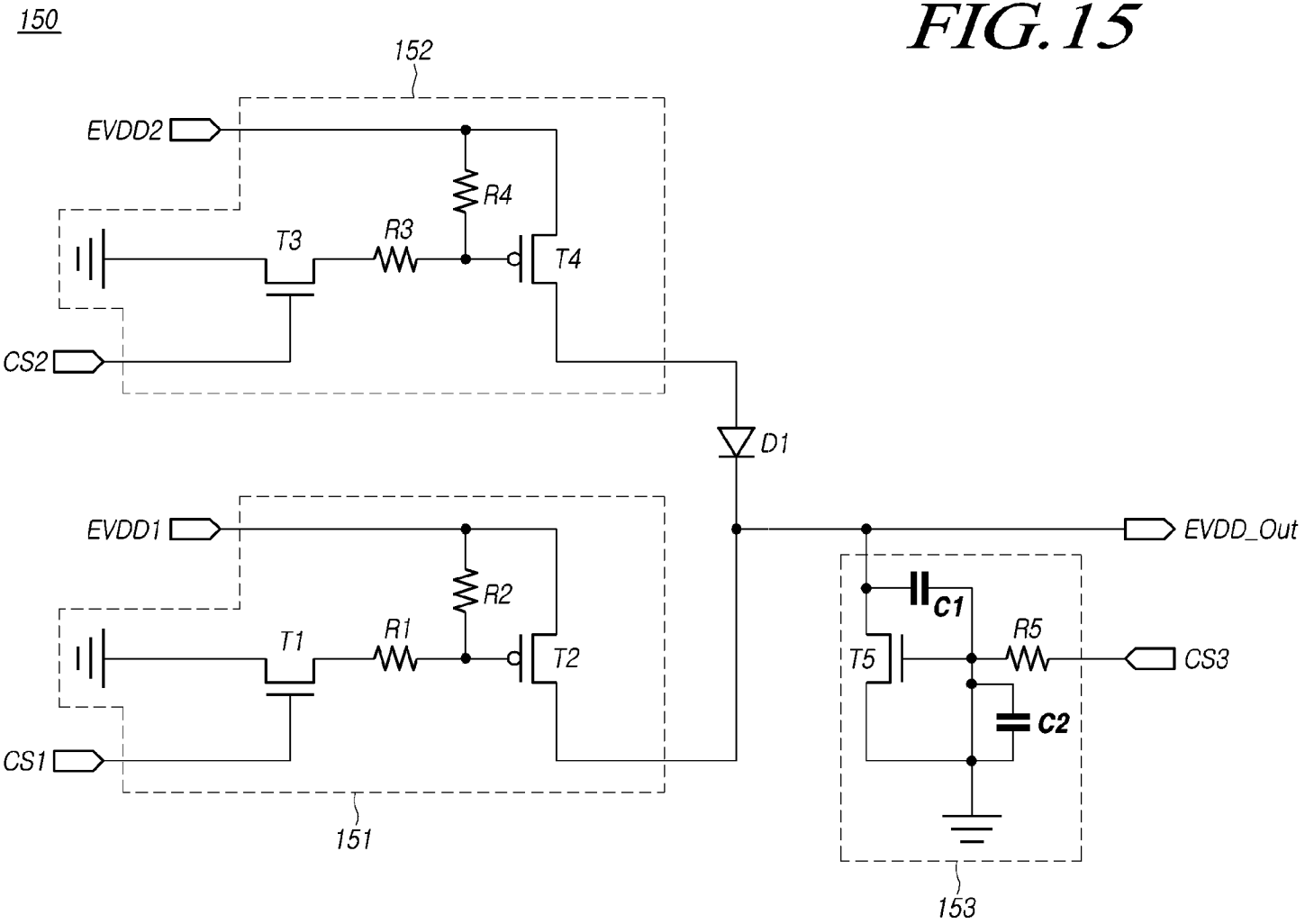
FIG. 15 is a diagram illustrating another example of the structure of the drive voltage supply circuit illustrated in FIG. 9.

FIG. 15 is a diagram illustrating another example of the structure of the drive voltage supply circuit 150 illustrated in FIG. 9.

Referring to FIG. 15, the drive voltage supply circuit 150 according to the aspects of the disclosure may include a first drive voltage output circuit 151, a second drive voltage output circuit 152, and a discharge circuit 153.

The first drive voltage output circuit 151 is electrically connected between an input terminal of a first drive voltage EVDD1 which is supplied from an external power supply and a drive voltage output terminal EVDD_Out and can operate in accordance with a first control signal CS1 which is output from the controller 140.

The first drive voltage output circuit 151 includes a first transistor T1 that is turned on or off in accordance with the first control signal CS1 and a second transistor T2 that controls outputting of the first drive voltage EVDD1. The first drive voltage output circuit 151 further includes a first resistor R1 that is connected between gate nodes of the first transistor T1 and the second transistor T2 and a second resistor R2 that is connected between the input terminal of the first drive voltage EVDD1 and the gate node of the second transistor T2.

When the first control signal CS1 with a high level is input to the first drive voltage output circuit 151 from the controller 140, the first transistor T1 is turned on and the ground voltage is supplied to the gate node of the second transistor T2. Then, the second transistor T2 is turned on and the first drive voltage EVDD1 is output to the drive voltage output terminal EVDD_Out.

Accordingly, the first drive voltage output circuit 151 can supply the first drive voltage EVDD1 to the display panel 110 in the display driving period.

The second drive voltage output circuit 152 is electrically connected between the input terminal of the second drive voltage EVDD2 and the drive voltage output terminal EVDD_Out and can operate in accordance with a second control signal CS2 which is output from the controller 140.

The second drive voltage output circuit 152 includes a third transistor T3 that is turned on or off in accordance with the second control signal CS2 and a fourth transistor T4 that controls outputting of the second drive voltage EVDD2. The second drive voltage output circuit 152 further includes a third resistor R3 that is connected between gate nodes of the third transistor T3 and the fourth transistor T4 and a fourth resistor R4 that is connected between the input terminal of the second drive voltage EVDD and the gate node of the fourth transistor T4.

The second drive voltage EVDD2 input to the second drive voltage output circuit 152 can be supplied from a power supply which is provided separately from a power supply that supplies the first drive voltage EVDD1. Alternatively, the second drive voltage EVDD2 may be a voltage which is generated by lowering a level of a voltage input from the power supply that supplies the first drive voltage EVDD1.

When the second control signal CS2 with a high level is input to the second drive voltage output circuit 152 from the controller 140, the third transistor T3 is turned on and the ground voltage is supplied to the gate node of the fourth transistor T4 to turn on the fourth transistor T4. When the fourth transistor T4 is turned on, the second drive voltage EVDD2 is output to the drive voltage output terminal EVDD_Out.

A first diode D1 is disposed between the second drive voltage output circuit 152 and the drive voltage output terminal EVDD_Out to prevent a current from flowing to the second drive voltage output circuit 152 with a relatively low voltage level.

In this way, the second drive voltage output circuit 152 can be supplied with the second control signal CS2 and output the second drive voltage EVDD2 in the deterioration sensing period, thereby enabling deterioration sensing in a state in which the second drive voltage EVDD2 is supplied to the display panel 110.

The discharge circuit 153 is connected to the drive voltage output terminal EVDD_Out and can operate in accordance with a third control signal CS3 which is input from the controller 140.

The discharge circuit 153 can include a fifth transistor T5 that is electrically connected between the drive voltage output terminal EVDD_Out and the ground and a fifth resistor R5 that is connected to a gate node of the fifth transistor T5.

The discharge circuit 153 can further include a first capacitor C1 that is electrically connected between the drive voltage output terminal EVDD_Out and the gate node of the fifth transistor T5. The discharge circuit 153 can further include a second capacitor C2 that is electrically connected between the gate node of the fifth transistor T5 and the ground.

The discharge circuit 153 is supplied with the third control signal CS3 with a high level output from the controller 140 between the display driving period and the deterioration sensing period.

When the third control signal CS3 with a high level is supplied, the fifth transistor T5 is turned on and the first drive voltage EVDD1 supplied to the display panel 110 can be discharged to the ground.

Here, since the first capacitor C1 is disposed between the drive voltage output terminal EVDD_Out and the gate node of the fifth transistor T5, it is possible to control a discharge speed of the first drive voltage EVDD1 which is discharged by the discharge circuit 153.

That is, by disposing the first capacitor C1 having constant capacitance, it is possible to control the discharge speed of the first drive voltage EVDD1 which is discharged by the discharge circuit 153 on the basis of the discharge speed of the first capacitor C1.

For example, when circuit elements included in the discharge circuit 153 are as follows, the discharge speed of the first capacitor C1 can be calculated as follows.

| CS3 (V) | R5 (kΩ) | C1 (nF) | EVDD1 (V) | Vth (V) | Discharge time (ms) |
|---|---|---|---|---|---|
| 3.3 | 10 | 4.7 | 27 | 1 | 0.552 |
| 2.2 | 10 | 4.7 | 27 | 2.5 | 1.586 |

When the high-level voltage of the third control signal CS3 is 3.3 V, resistance of the fifth resistor R5 is 10 kΩ, capacitance of the first capacitor C1 is 4.7 nF, and a threshold voltage of the fifth transistor T5 is 1 V, a discharge time of the first capacitor C1 can be calculated as 4.7 nF×27 V/{(3.3 V−1 V)/10 kΩ}=0.552 ms. Alternatively, when the threshold voltage of the fifth transistor T5 is 2.5 V, the discharge time of the first capacitor C1 can be calculated as 4.7 nF×27 V/{(3.3 V−2.5 V)/10 kΩ}=1.586 ms.

In this way, by connecting the fifth resistor R5 having constant resistance to the gate node of the fifth transistor T5 and disposing the first capacitor C1 having constant capacitance between the drive voltage output terminal EVDD_Out and the gate node of the fifth transistor connected to the ground, it is possible to calculate the discharge speed of the first capacitor C1.

A current which flows in the process of discharge of the first drive voltage EVDD1 supplied to the display panel 110 can be calculated as follows on the basis of the discharge speed of the first capacitor C1.

| Discharge time (ms) | EVDD Cap. (μF) | EVDD1 (V) | Current (A) |
|---|---|---|---|
| 0.552 | 200 | 27 | 9.79 |
| 1.586 | 200 | 27 | 3.40 |

When the discharge time of the first capacitor C1 is 0.552 ms and drive voltage capacitance of the display panel 110 is 200 μF, the current flowing in the process of discharge can be calculated as 200 μF×27 V/0.552 ms=9.79 A. Alternatively, when the discharge time of the first capacitor C1 is 1.586 ms, the current flowing in the process of discharge can be calculated as 200 μF×27 V/1.586 ms=3.40 A.

That is, the current flowing in the process of discharge decreases as the discharge time of the first capacitor C1 increases. By decreasing the current flowing in the process of discharge, it is possible to prevent the fifth transistor T5 from being damaged in the process of discharge.

In this way, in the aspects of the disclosure, it is possible to prevent circuit elements included in the discharge circuit 153 from being damaged and to discharge the first drive voltage EVDD1 by adjusting the discharge time of the first drive voltage EVDD1 supplied to the display panel 110 to control the current flowing in the process of discharge between the display driving period and the deterioration sensing period. Accordingly, it is possible to effectively discharge the first drive voltage EVDD1 and to stably supply the second drive voltage EVDD2 in the deterioration sensing period.

Figure 16:
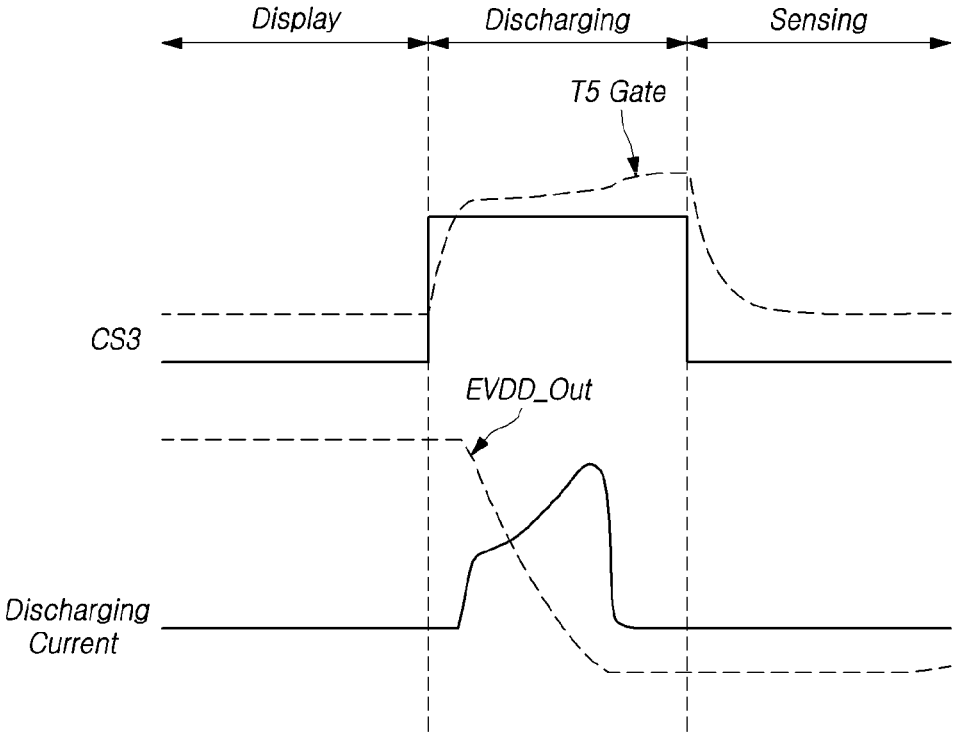
FIG. 16 is a diagram illustrating an example of a discharge waveform of a drive voltage supplied to the display panel in the process of discharge of the drive voltage supply circuit illustrated in FIG. 15.

FIG. 16 is a diagram illustrating an example of a discharge waveform of the first drive voltage EVDD1 supplied to the display panel 110 in the process of discharge in the drive voltage supply circuit 150 illustrated in FIG. 15.

Referring to FIG. 16, the third control signal CS3 with a high level is supplied to the discharge circuit 153 of the drive voltage supply circuit 150 in a period between the display driving period and the deterioration sensing period. Accordingly, the voltage of the gate node of the fifth transistor T5 increases and the first drive voltage EVDD1 supplied to the display panel 110 is discharged by the discharge circuit 153.

Here, since the fifth resistor R5 having constant resistance and the first capacitor C1 having constant capacitance are disposed in the discharge circuit 153, the discharge time can be controlled such that the current flowing in the process of discharge does not increase fast.

Accordingly, the voltage of the drive voltage output terminal EVDD_Out, that is, the first drive voltage EVDD1 supplied to the display panel 110, is gradually discharged and discharge can be stably performed without damage of circuit elements included in the discharge circuit 153.

On the other hand, the current flowing in the process of discharge can be controlled by disposing the first capacitor C1, but the voltage of the gate node of the fifth transistor T5 can increase due to coupling by the first capacitor C1 at a time point at which supply of the first drive voltage EVDD1 for display driving is started.

According to the aspects of the disclosure, since the second capacitor C2 having capacitance greater than that of the first capacitor C1 is disposed between the gate node of the fifth transistor T5 and the ground, it is possible to prevent the voltage of the gate node of the fifth transistor T5 from increasing at the time point at which the first drive voltage EVDD1 is supplied.

Figure 17:
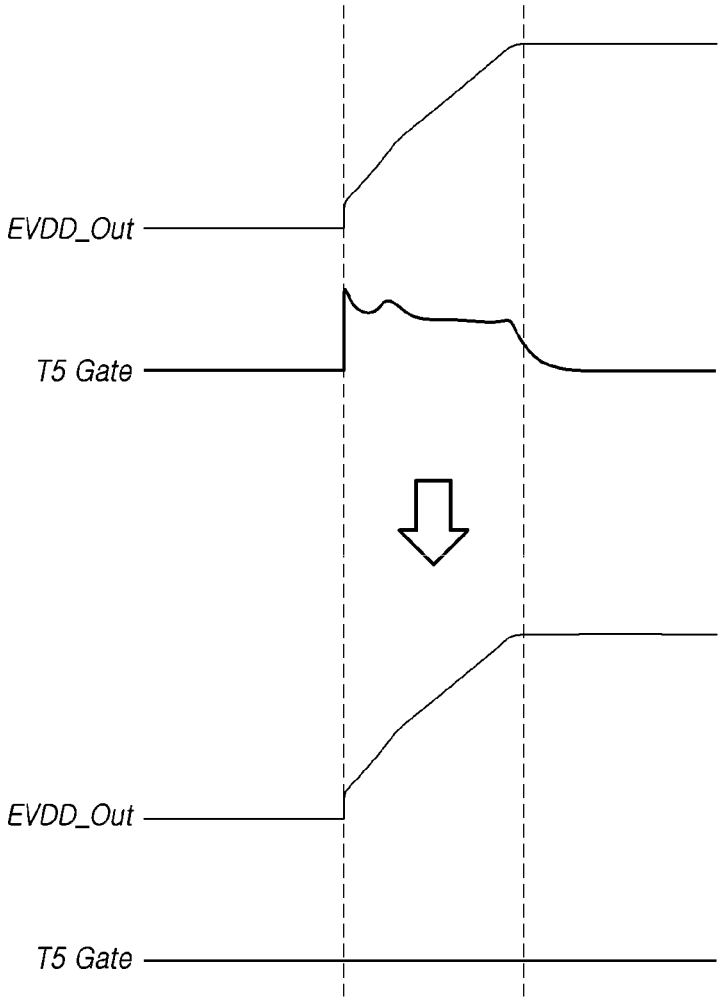
FIG. 17 is a diagram illustrating an example of a voltage state of a gate node of a transistor included in a discharge circuit when supply of a drive voltage for display driving is started by the drive voltage supply circuit illustrated in FIG. 15.

FIG. 17 is a diagram illustrating an example of a voltage state of the gate node of the discharge control transistor T5 included in the discharge circuit 153 when supply of the first drive voltage EVDD1 for display driving is started by the drive voltage supply circuit 150 illustrated in FIG. 15.

Referring to FIG. 17, the first drive voltage output circuit 151 of the drive voltage supply circuit 150 outputs the first drive voltage EVDD1 at a time point at which the display device 100 is turned on and starts display driving or at a time point at which display driving is started after a deterioration sensing period.

When the first drive voltage output circuit 151 outputs the first drive voltage EVDD1, the voltage level of the drive voltage output terminal EVDD_Out increases.

Here, since the first capacitor C1 is disposed between the drive voltage output terminal EVDD_Out and the gate node of the fifth transistor T5, the voltage of the gate node of the fifth transistor T5 can increase due to coupling to the drive voltage output terminal EVDD_Out.

In this case, the fifth transistor T5 is turned on and the discharge circuit 153 can operate to discharge the first drive voltage EVDD1.

However, since the second capacitor C2 having capacitance greater than that of the first capacitor C1 is disposed between the gate node of the fifth transistor T5 and the ground, the voltage of the gate node of the fifth transistor T5 can be prevented from increasing even in the period in which the voltage of the drive voltage output terminal EVDD_Out increases.

That is, by connecting the second capacitor C2 having greater capacitance between the gate node of the fifth transistor T5 and the ground, it is possible to keep the voltage of the gate node of the fifth transistor T5 constant and to prevent the fifth transistor T5 from being turned on at the time point at which the first drive voltage EVDD1 is supplied.

According to the aspects of the disclosure, by supplying the second drive voltage EVDD2 lower than the first drive voltage EVDD1 required for display driving in the deterioration sensing period of each organic light emitting diode OLED, it is possible to keep the operating voltage of the organic light emitting diode OLED constant and to accurately sense deterioration of the organic light emitting diode OLED.

By providing the drive voltage supply circuit 150 that supplies the first drive voltage EVDD1 in the display driving period, supplies the second drive voltage EVDD2 in the deterioration sensing period, and discharges the first drive voltage EVDD1 supplied to the display panel 110 between the display driving period and the deterioration sensing period, it is possible to stably supply the drive voltages EVDD required for display driving and deterioration sensing.

By disposing the resistor having constant resistance and the capacitor having constant capacitance in the discharge circuit 153 of the drive voltage supply circuit 150 and controlling the discharge time of the first drive voltage EVDD1, it is possible to prevent circuit elements from being damaged due to a fast increase of a current in the process of discharge and to stably supply the drive voltage EVDD.

The above description merely exemplifies the technical idea of the present disclosure, and various modifications and changes can be made by those skilled in the art without departing from the essential features of the disclosure. The aspects disclosed in the disclosure are not for restricting the technical idea of the disclosure but for explaining the technical idea of the disclosure. Accordingly, the technical scope of the disclosure is not limited by the aspects. The scope of the disclosure is defined by the appended claims, and all the technical ideas within a range equivalent thereto should be construed as belonging to the scope of the disclosure.

What is claimed is:

1. A display device comprising:
- a display panel in which a plurality of gate lines, a plurality of data lines, and a plurality of subpixels are arranged;
- a gate driving circuit that drives the plurality of gate lines;
- a data driving circuit that drives the plurality of data lines;
- a drive voltage supply circuit that supplies a drive voltage to the display panel; and
- a controller that controls the gate driving circuit, the data driving circuit, and the drive voltage supply circuit,
- wherein each of the plurality of subpixels includes an organic light emitting diode, a driving transistor that drives the organic light emitting diode, a switching transistor that is electrically connected between a gate node of the driving transistor and a corresponding data line, and a sensing transistor that is electrically connected between a source node or a drain node of the driving transistor and a reference voltage line, and
- wherein the drive voltage supply circuit supplies a first drive voltage to the display panel through at least one drive voltage line during a display driving period, supplies a second drive voltage lower than the first drive voltage to the display panel through the at least one drive voltage line during a deterioration sensing period, and the first drive voltage supplied to the display panel being discharged between the display driving period and the deterioration sensing period.

2. The display device according to claim 1, wherein the drive voltage supply circuit comprises:
- a drive voltage output terminal that is electrically connected to a drive voltage line disposed in the display panel;
- a first drive voltage output circuit that is electrically connected between the drive voltage output terminal and an external power supply and outputting the first drive voltage to the drive voltage output terminal;
- a second drive voltage output circuit that is electrically connected to the drive voltage output terminal and outputting the second drive voltage to the drive voltage output terminal; and
- a discharge circuit that is electrically connected between the drive voltage output terminal and a ground.

3. The display device according to claim 2, wherein the discharge circuit comprises:
- a discharge control transistor that is electrically connected between the drive voltage output terminal and the ground and operating in accordance with a discharge control signal which is output from the controller;

a discharge speed control resistor that is electrically connected to a gate node of the discharge control transistor; and a first capacitor that is electrically connected between the drive voltage output terminal and the gate node of the discharge control transistor.

4. The display device according to claim 3, wherein the discharge circuit further comprises a second capacitor that is electrically connected between the gate node of the discharge control transistor and the ground and having a capacitance greater than that of the first capacitor.

5. The display device according to claim 3, wherein the gate node of the discharge control transistor is electrically connected to the ground.

6. The display device according to claim 2, wherein the drive voltage supply circuit further comprises a second drive voltage generating circuit that is electrically connected between the external power supply and the second drive voltage output circuit and generating the second drive voltage based on a voltage supplied from the external power supply.

7. The display device according to claim 2, wherein the drive voltage supply circuit further includes a diode that is electrically connected between the second drive voltage output circuit and the drive voltage output terminal.

8. The display device according to claim 1, wherein the controller outputs a display control signal for outputting the first drive voltage from the drive voltage supply circuit during the display driving period, and outputs a sensing control signal for outputting the second drive voltage from the drive voltage supply circuit during the deterioration sensing period.

9. The display device according to claim 8, wherein the controller outputs a discharge control signal for discharging the first drive voltage from the drive voltage supply circuit during at least a portion of a period between the display driving period and the deterioration sensing period.

10. The display device according to claim 8, wherein the controller has a preset time interval between the period in which the controller outputs the discharge control signal and the period in which the controller outputs the sensing control signal.

11. The display device according to claim 1, wherein the data driving circuit supplies a sensing data voltage to at least some subpixels of the plurality of subpixels via the data lines in the deterioration sensing period and senses quantities of electric charge charged in the organic light emitting diodes disposed in the subpixels to which the sensing data voltage is supplied.

12. A display panel comprising:

a plurality of gate lines;

a plurality of data lines;

a plurality of subpixels that are defined in areas in which the gate lines and the data lines intersect each other, each of the plurality of subpixels comprising an organic light emitting diode, a driving transistor that drives the organic light emitting diode, a switching transistor that is electrically connected between a gate node of the driving transistor and the corresponding data line, and a sensing transistor that is electrically connected between a source node or a drain node of the driving transistor and a reference voltage line; and at least one drive voltage line supplied with a first drive voltage in a display driving period, and supplied with a second drive voltage lower than the first drive voltage during a deterioration sensing period, and the first drive voltage being discharged between the display driving period and the deterioration sensing period.

* * * * *